US005233664A

United States Patent [19]

Yanagawa et al.

[11] Patent Number: 5,233,664

[45] Date of Patent: Aug. 3, 1993

[54] SPEAKER SYSTEM AND METHOD OF CONTROLLING DIRECTIVITY THEREOF

[75] Inventors: Hirofumi Yanagawa; Keishi Saito, both of Tokyo; Sumio Hagiwara, Saitama, all of Japan

[73] Assignee: Pioneer Electronic Corporation, Tokyo, Japan

[21] Appl. No.: 831,800

[22] Filed: Feb. 4, 1992

[30] Foreign Application Priority Data

Aug. 7, 1991 [JP] Japan ..... 3-197864

[51] Int. Cl.[5] ..... H04R 1/02

[52] U.S. Cl. ..... 381/89; 381/97; 381/182

[58] Field of Search ..... 381/97, 111, 182, 89, 381/90, 188, 205

[56] References Cited

U.S. PATENT DOCUMENTS 4,399,328 8/1983 Franssen .
4,472,834 9/1984 Yamamuro et al. .
4,845,759 7/1989 Danley ..... 381/97

FOREIGN PATENT DOCUMENTS 44943 6/1950 Fed. Rep. of Germany .
3018001 7/1986 Fed. Rep. of Germany .
63-425599 2/1988 Japan ..... 381/97
2-239798 9/1990 Japan .
1456790 11/1976 United Kingdom .

OTHER PUBLICATIONS

Wollherr; Horst Schrage Sache, In: Funkschau, H.2, 1985, S. 41–43.

Jordan, E. J.: Multiple-array Loudspeaker System. In: Wireless World, Mar. 1971, S. 132–134.

Vasilocov; E. A.: Titel Kyrillisch-Die Biologie der Richtfahigkeit der Strahlungsfelder durch kleine akusitsche Umformer In: Defektoskopia, 9.H.5, 1973, S. 76–80.

Beigel, "A Digital Phase Shifter' for Musical Applications, Using the Bell Labs" (Alles Fischer) Digital Filter Module, JAES, Sep. 1979, vol. 27, No. 9.

*Primary Examiner*—Forester W. Isen

*Attorney, Agent, or Firm*—Sughrue, Mion, Zinn, Macpeak & Seas

[57] ABSTRACT

A speaker system including a common input terminal for receiving an audio signal to be acoustically radiated; several speaker units; several digital filters connected between the common input terminal and the speaker units, and a filter coefficient for each of the digital filters. The speaker units are arranged linearly, in a matrix form or in a honeycomb form.

19 Claims, 29 Drawing Sheets

A ... AMPLITUDE CHARACTERISTIC OF FIR FILTER
B ... PHASE CHARACTERISTIC OF FIR FILTER
a ... AMPLITUDE CHARACTERISTIC OF ANALOG FILTER
b ... PHASE CHARACTERISTIC OF ANALOG FILTER
AMPLITUDE
2.0
1.0
FREQUENCY [Hz]
0
200
400
600
800
1000
1200
1400
1600
1800
2000
PHASE ANGLE [°]
180°
140
110
72
36
0
-36
-72
-110
-140
-180°
A
a
B
b

PLAN PATTERN

FRONT PATTERN

SIDE PATTERN

PERSPECTIVE PATTERN

PLAN PATTERN

FRONT PATTERN

SIDE PATTERN

PERSPECTIVE PATTERN

PLAN PATTERN

FRONT PATTERN

SIDE PATTERN

PERSPECTIVE PATTERN

PLAN PATTERN

FRONT PATTERN

SIDE PATTERN

PERSPECTIVE PATTERN

PLAN PATTERN

FRONT PATTERN

SIDE PATTERN

PERSPECTIVE PATTERN

PLAN PATTERN

FRONT PATTERN

SIDE PATTERN

PERSPECTIVE PATTERN

PLAN PATTERN

FRONT PATTERN

SIDE PATTERN

PERSPECTIVE PATTERN

PLAN PATTERN

FRONT PATTERN

SIDE PATTERN

PERSPECTIVE PETTERN

PLAN PATTERN

FRONT PATTERN

SIDE PATTERN

PERSPECTIVE PATTERN

PLAN PATTERN

FRONT PATTERN

SIDE PATTERN

PERSPECTIVE PATTERN

PLAN PATTERN

FRONT PATTERN

SIDE PATTERN

PERSPECTIVE PATTERN

PLAN PATTERN

FRONT PATTERN

SIDE PATTERN

PERSPECTIVE PATTERN

SPEAKER SYSTEM AND METHOD OF CONTROLLING DIRECTIVITY THEREOF

BACKGROUND OF THE INVENTION

The present invention relates to a speaker system and a method of controlling a speaker system's directivity and, more particularly, to a system and method of controlling the directivity of a linearly or two-dimensionally arranged speaker system.

Directivity is one of the characteristics used to evaluate the performance of a speaker. Directivity is a property that the magnitude of a sound pressure differs depending on direction. It cannot indiscriminately be said that a wider directivity is better in all applications. There are various directivity patterns for various applications of a speaker, i.e., the range of service of the speaker. For example, for audio use, a wide directivity is preferred, while for loudspeaking applications, a narrow directivity is called for so that voice is radiated only in a predetermined direction to prevent howling, etc.

On the other hand, factors determining the directivity of a speaker include: for a single speaker unit, the structure of a the speaker unit itself, whether it is a cone type or a horn type; and for a cone type speaker, the depth of a cone forming its diaphragm. Further, there is a type of sound that is radiated only in a predetermined direction by a linearly arranged speaker (the so-called "Tonesaulen type") using a plurality of speaker units. At any rate, the directivity of a speaker is determined by the physical structure or arrangement of the speaker unit itself. However, not only does it take time and labor to fabricate a speaker that meets a directivity requirement, but also restrictions are often imposed on the outside dimensions, etc. To overcome this problem, a speaker system that controls its directivity electrically using digital filters has been developed (see Japanese Patent Unexamined Publication No. Hei. 2-239798).

However, the above speaker system is intended to obtain consistent directivity covering a wide range from low to high frequencies, and in the literature there is no indication of any specific control method of obtaining directivity in a desired direction.

SUMMARY OF THE INVENTION

Accordingly, an object of the present invention is to provide a speaker system and a method of controlling its directivity, which can arbitrarily and variably control not only two-dimensional directivity but also three-dimensional directivity by means of electric signal processing.

A first embodiment of the invention is applied to a speaker system comprising: a common input terminal for receiving an audio signal to be acoustically radiated; a plurality of speaker units which are linearly arranged; and a plurality of digital filters which are connected by insertion between the common input terminal and the speaker units, respectively, lo each of the plurality of digital filters having a filter coefficient being set so as to correspond to each of the speaker units to be connected thereto, the filter coefficient being determined by a nonlinear optimization method in accordance with a target directivity pattern into which the audio signal is acoustically radiated by the plurality of speaker units.

A second embodiment of the invention is applied to a speaker system comprising: a common input terminal for receiving an audio signal to be acoustically radiated; a plurality of speaker units which are arranged on a plane in matrix form; and a plurality of digital filters which are connected by insertion between the common input terminal and the speaker units, respectively, each of the plurality of digital filters having a filter coefficient being set so as to correspond to each of the speaker units to be connected thereto, the filter coefficient being determined by a nonlinear optimization method in accordance with a target directivity pattern into which the audio signal is acoustically radiated by the plurality of speaker units.

A third embodiment of the invention is applied to a speaker system comprising: a common input terminal for receiving an audio signal to be acoustically radiated; a plurality of speaker units which are arranged in honeycomb form; and a plurality of digital filters which are connected by insertion between the common input terminal and the speaker units, respectively, each of the plurality of digital filters having a filter coefficient being set so as to correspond to each of the speaker units to be connected thereto, the filter coefficient being determined by a nonlinear optimization method in accordance with a target directivity pattern into which the audio signal is acoustically radiated by the plurality of speaker units.

According to the first embodiment of the invention, a sound signal fed to the common input terminal is sent to the respective linearly arranged speaker units via the digital filters. A filter coefficient is set to each digital filter to reproduce a target directivity pattern for acoustic radiation by a group of the linearly arranged speaker units. These filter coefficients are determined by a nonlinear optimization method so as to match the target $ directivity pattern. The filter coefficients take values which are different from each other and are set on a speaker unit basis. Accordingly, a digital filter is provided for every speaker unit, on a one-by-one basis, and each digital filter has an inherent filter coefficient, so that each speaker unit can be controlled individually. Thus, any arbitrary change of the filter coefficient in accordance with the target directivity pattern allows a speaker to electrically control its directivity more finely without changing the speaker structure.

According to the second embodiment of the invention, the speaker units are arranged on a plane in a matrix form. As a result, the speaker system is provided with a directivity that is determined by the planar arrangement of the speaker units. Such a directivity appears not only in a single arrangement direction as in the linearly arranged speaker system (e.g., in a horizontal direction), but also in a different arrangement direction (i.e., in a vertical direction). Therefore, in determining each filter coefficient by the nonlinear optimization method, the directivity in the required horizontal and vertical directions is added, and by setting the thus determined filter coefficients to the respective digital filters, the directivity in the horizontal and vertical directions can be electrically controlled arbitrarily without changing the structure of the speaker system.

According to the third embodiment of the invention, the speaker units are arranged to be controlled in both horizontal and vertical directions by interaction between the plane arrangement and the digital filters, but also provides the following advantages. Compared to the speaker system having the two-dimensionally arranged matrix-like speaker system, the distance between speaker units can be narrowed. As a result, the speaker system can be down-sized, the frequency range (particularly, an upper limit frequency) whose directivity that is controllable can be increased, and the upper frequencies can be made consistent among the speaker units.

DETAILED DESCRIPTION OF THE PREFERRED EMBODIMENTS

The preferred embodiments of the invention will now be described with reference to the drawings.

A speaker system according to a first embodiment of the invention is shown in FIGS. 1 to 24. This embodiment is an example in which the invention is applied to a speaker array having a plurality of linearly-arranged speaker units.

Figure 1:
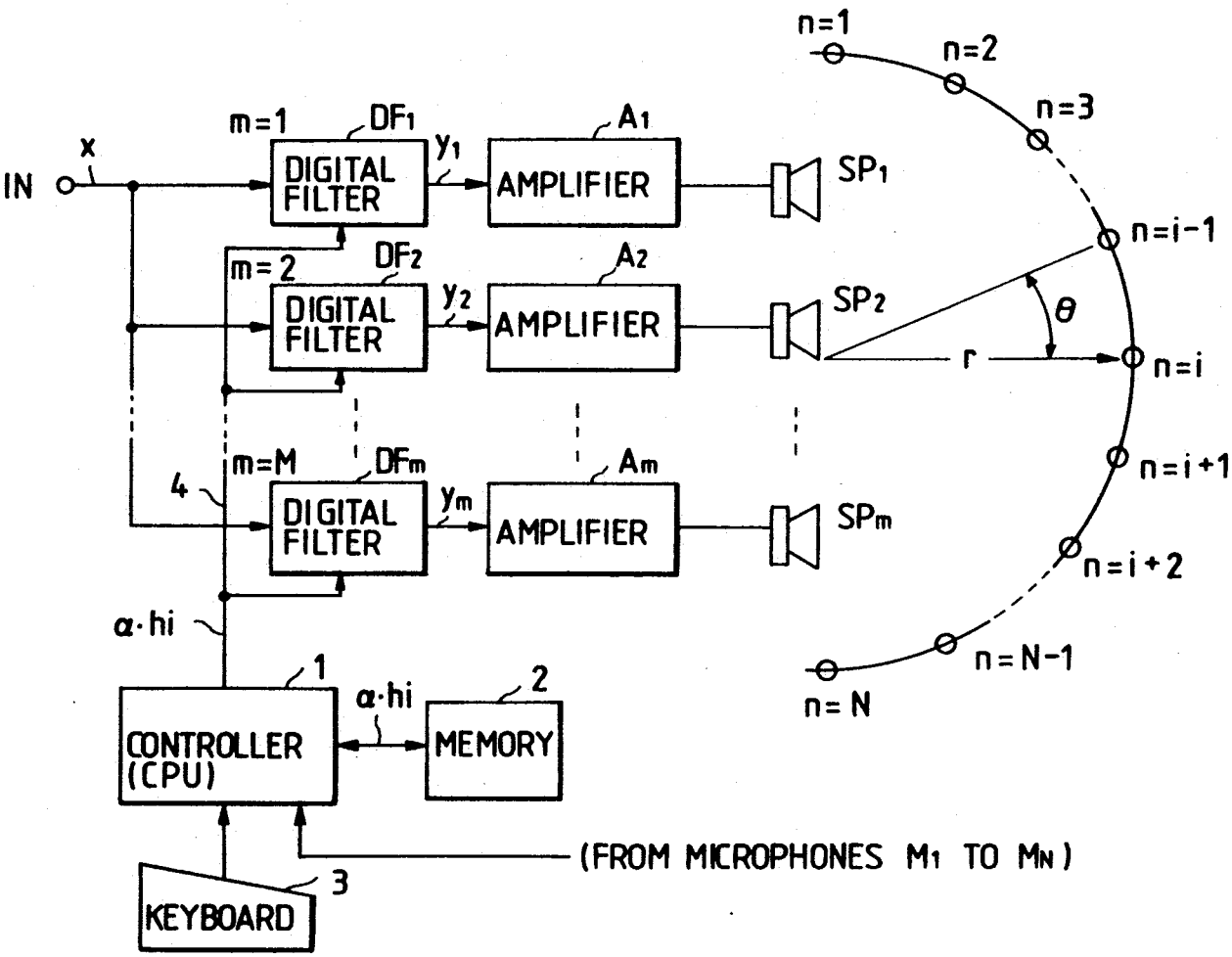
FIG. 1 is a block diagram showing an exemplary speaker system of the invention.

As shown in FIG. 1, the speaker system has a single common input signal terminal IN, and this common input signal terminal IN is branched into a plurality of speaker units $SP_1$ to $SP_m$ so that each of the speaker units $SP_1$ to $SP_m$ can be driven in parallel. To signal lines on the branch paths between the common input signal terminal IN and the speaker units $SP_1$ to $SP_m$ are digital filters $DF_1$ to $DF_m$ and amplifiers $A_1$ to $A_m$ connected to the speaker units $SP_1$ to $SP_m$, respectively, on a one-to-one basis, as shown in FIG. 1. The amplifiers $A_1$ to $A_m$ are connected to the digital filters $DF_1$ to $DF_m$, respectively, in series with each other. A signal line 4 from a controller 1 is connected to each of the digital filters $DF_1$ to $DF_m$. The controller 1 sets inherent filter coefficient data $\alpha hi$ to each of the digital filters $DF_1$ to $DF_m$ through signal line 4. The filter coefficient data αhi is stored in a memory 2, and is sequentially set to each of the digital filters $DF_1$ to $DF_m$ by instruction from an input keyboard 3.

Figure 2:
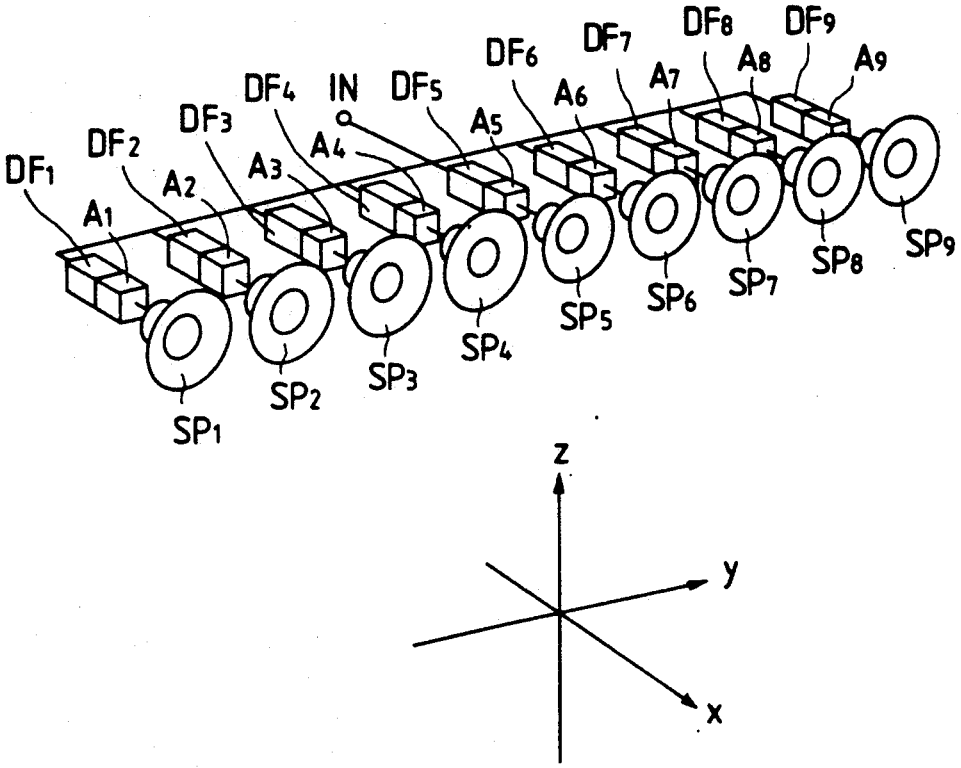
FIG. 2 is a perspective view showing the appearance of a linearly arranged speaker system, which is a first embodiment of the invention.

As shown in FIG. 2, the speaker units $SP_1$ to $SP_m$ (which in this example m=9) constitute a speaker array arranged linearly equidistantly in a single direction (e.g., in the y-axis direction). It is preferable that the physical properties of each of the speaker units $SP_1$ to $SP_m$, e.g., factors regulating the characteristics of the speaker unit (diameter, minimum resonance frequency, mass of the diaphragm, etc.) be equal to one another. Whether the reproducing frequency range is divided into three, i.e., woofer, squawker, and tweeter, or is of a full-range type, may be selected appropriately. Further, although not shown, whether each speaker unit is individually contained in an enclosure or all the speaker units are mounted on a single contiguous baffle plate or on a wall, etc. may be designed appropriately as the case may require, i.e., this design will depend upon the particular use of the speaker system. In FIG. 2, it is assumed that the x-axis indicates a direction of sound radiation, the y-axis, a direction of width (or the horizontal direction); and the z-axis, a direction of height (or the vertical direction).

Each of the digital filters $DF_1$ to $DF_m$ is implemented by a digital signal processor (DSP) and formed into an ordinary direct FIR (finite impulse response) filter. The hardware, although not shown, includes: an arithmetic and logic unit (ALU) for performing arithmetic and logic operations, which are the core of the signal processing; a sequencer (including a program counter, an instruction register, and a decoder) for controlling an operation sequence; a ROM (read only memory) for storing necessary programs; a RAM (random access memory) for storing data; registers for temporarily storing the data; an input/output device for receiving and sending the data from and to an external device; and buses for interconnecting the above elements.

As is known well, an output signal $Y_{(n)}$ of a direct FIR filter can be expressed as follows, with i, $x_{(n)}$ (input signal), and αhi (filter coefficient data), with i being a positive integer from 0 to N-1.

$$Y_{(n)} = \sum_{i=0}^{N-1} \alpha hi \cdot x_{(n)} \tag{1}$$

Hence, the FIR filter can change its filter characteristic arbitrarily by changing its filter coefficient αhi. The filter coefficient αhi is sent from the controller 1 as described previously and stored in a register (filter coefficient register) within the DSP as also described previously.

The amplifiers $A_1$ to $A_m$ are provided to amplify output signal levels of the digital filters $DF_1$ to $DF_m$ to levels large enough to drive the speaker units $SP_1$ to $SP_m$, respectively.

With the construction described above, a method of controlling the general directivity characteristic of sounds radiated from the speaker array consisting of speaker units $SP_1$ to $SP_m$ will now be described in conjunction with the flow chart of FIG. 3.

The control method will first be outlined. The general directivity characteristic of the speaker array is a collection of the sound pressures of individual sounds radiated from the respective speaker units $SP_1$ to $SP_m$. Thus, a desired characteristic can be obtained by controlling the output sound pressure of each of the speaker units $SP_1$ to $SP_m$. Thus, each of the filter coefficients of the digital filters $DF_1$ to $DF_m$ connected to the speaker units $SP_1$ to $SP_m$ is set to a value matching a desired target directivity pattern. To find a correct filter coefficient, sounds are first actually produced from a speaker array, its output sounds are measured by a microphone, and filter coefficients are subsequently calculated based on the measured values. In order to provide the calculations, it is necessary to implement a system for measuring the output sound pressures of the speaker array and calculate filter coefficients so that the actual directivity corresponds (i.e., approximated) to the target directivity, while evaluating the actual directivity using the obtained output sound pressures. If there are a number of target directivities, filter coefficients matching a target directivity is obtained. The construction of a measuring system and a calculation method will hereunder be described.

As shown in FIG. 1, to measure an actual directivity pattern to be developed on an xy plane (the horizontal direction), a plurality of measuring points n=1 to N are set. Each of the measuring point being distant from each of the speaker units $SP_1$ to $SP_m$ by a radius r in front thereof and each of the measuring points is distant from each other by an appropriate angle θ, as shown in FIG. 1. A microphone (not shown) is disposed at each measuring point n to measure the sound pressures from the speaker array. Sound pressure signals outputted from the respective microphones can be taken as the actual directivity Hyn (ω) of the speaker array.

Figure 3:
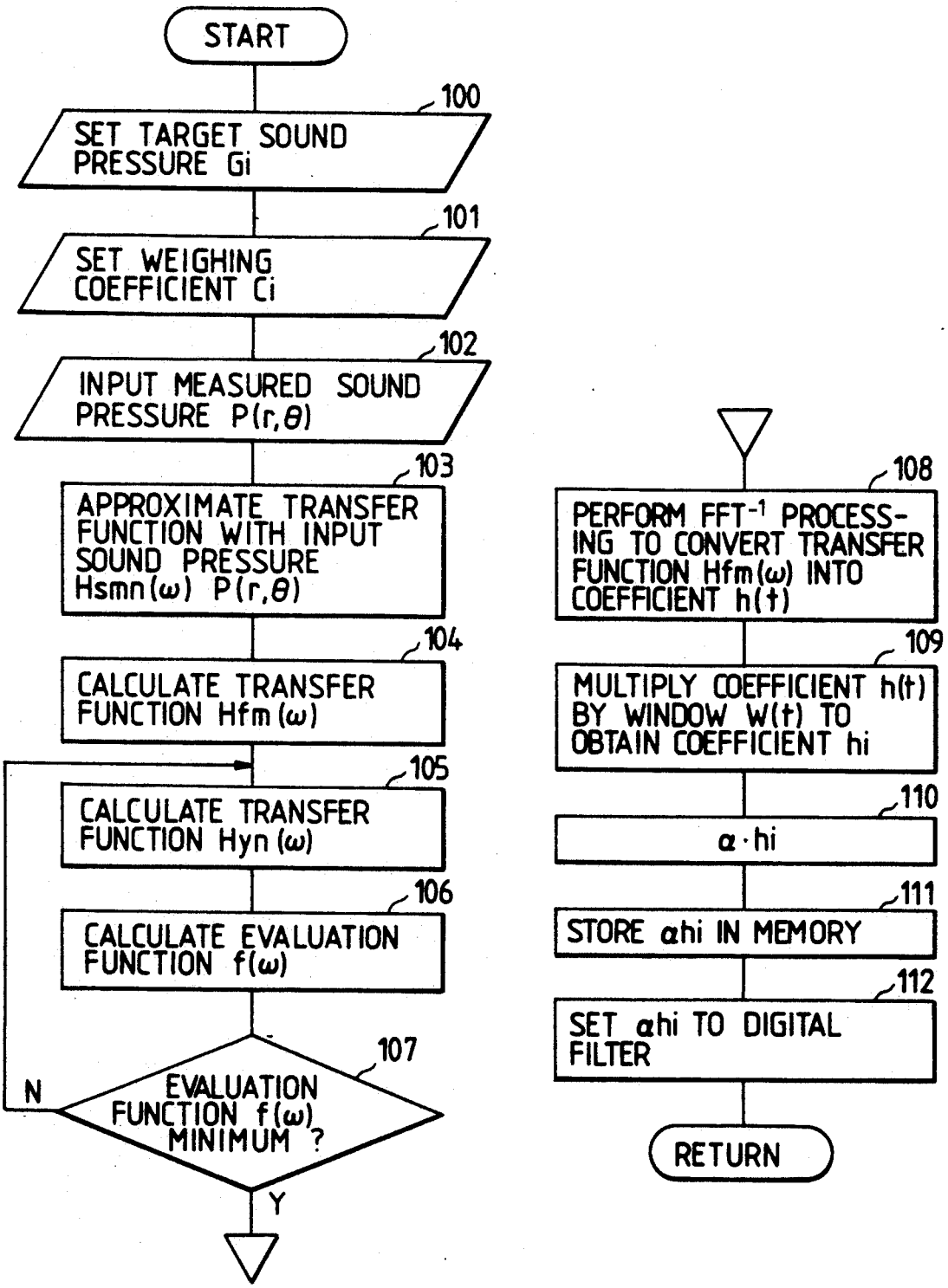
FIG. 3 is a flowchart showing a directivity controlling method according to the invention.
Figure 5:
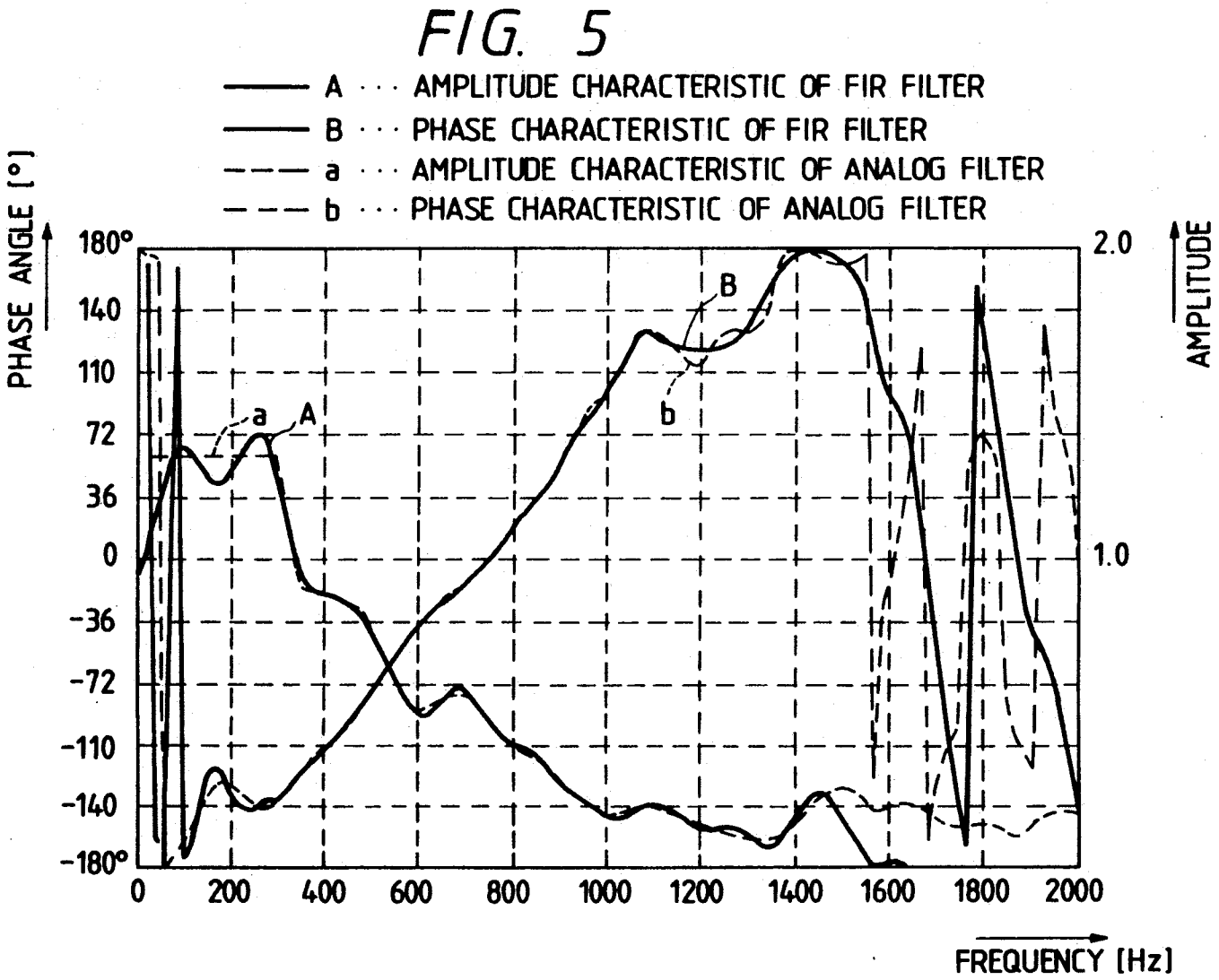
FIG. 5 is a graph diagram showing the frequency responses of a FIR filter (m=1) of the invention and an analog filter.
Figure 6:
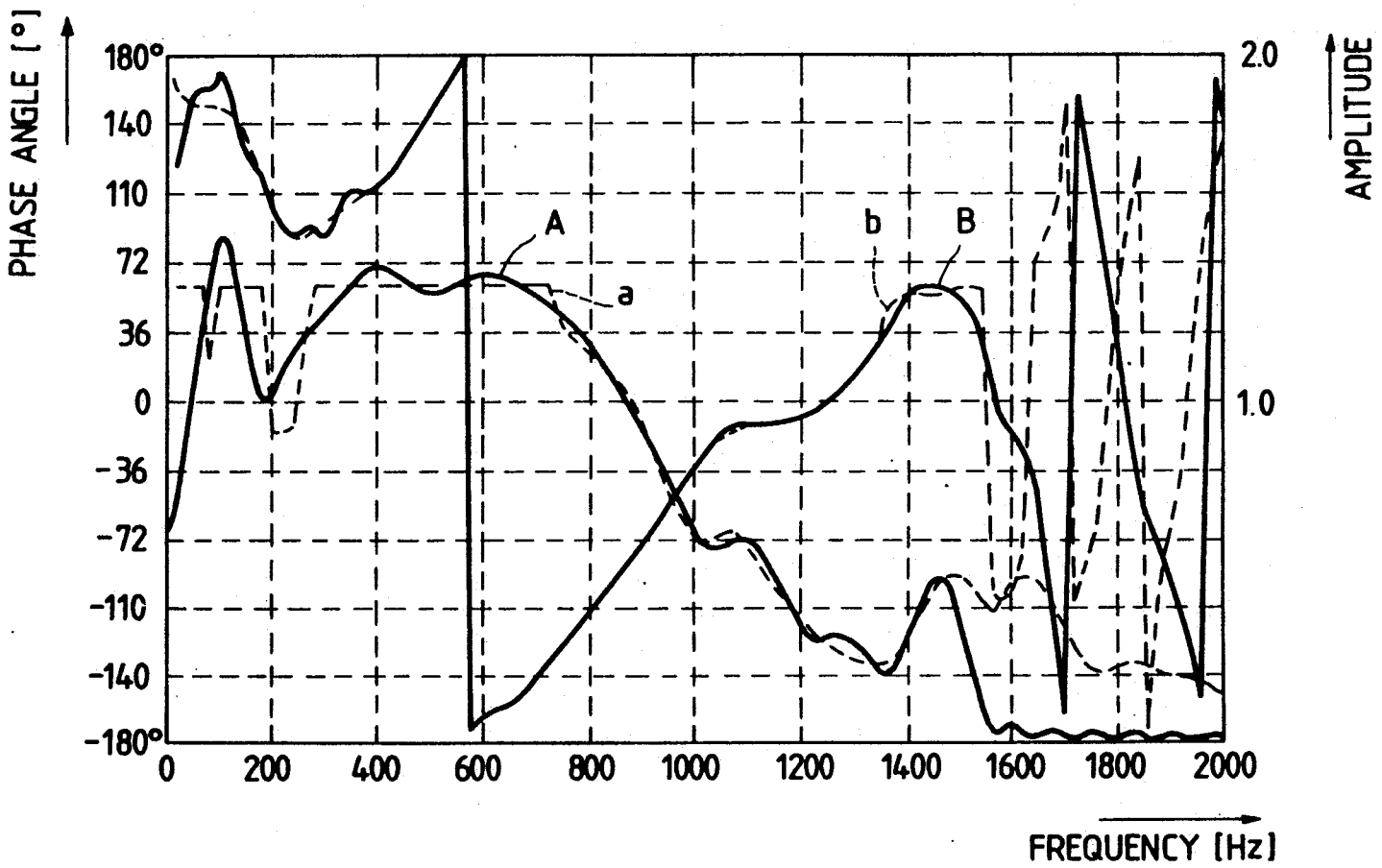
FIG. 6 is a graph diagram showing the frequency responses of a FIR filter (m=2) of the invention and an analog filter.
Figure 7:
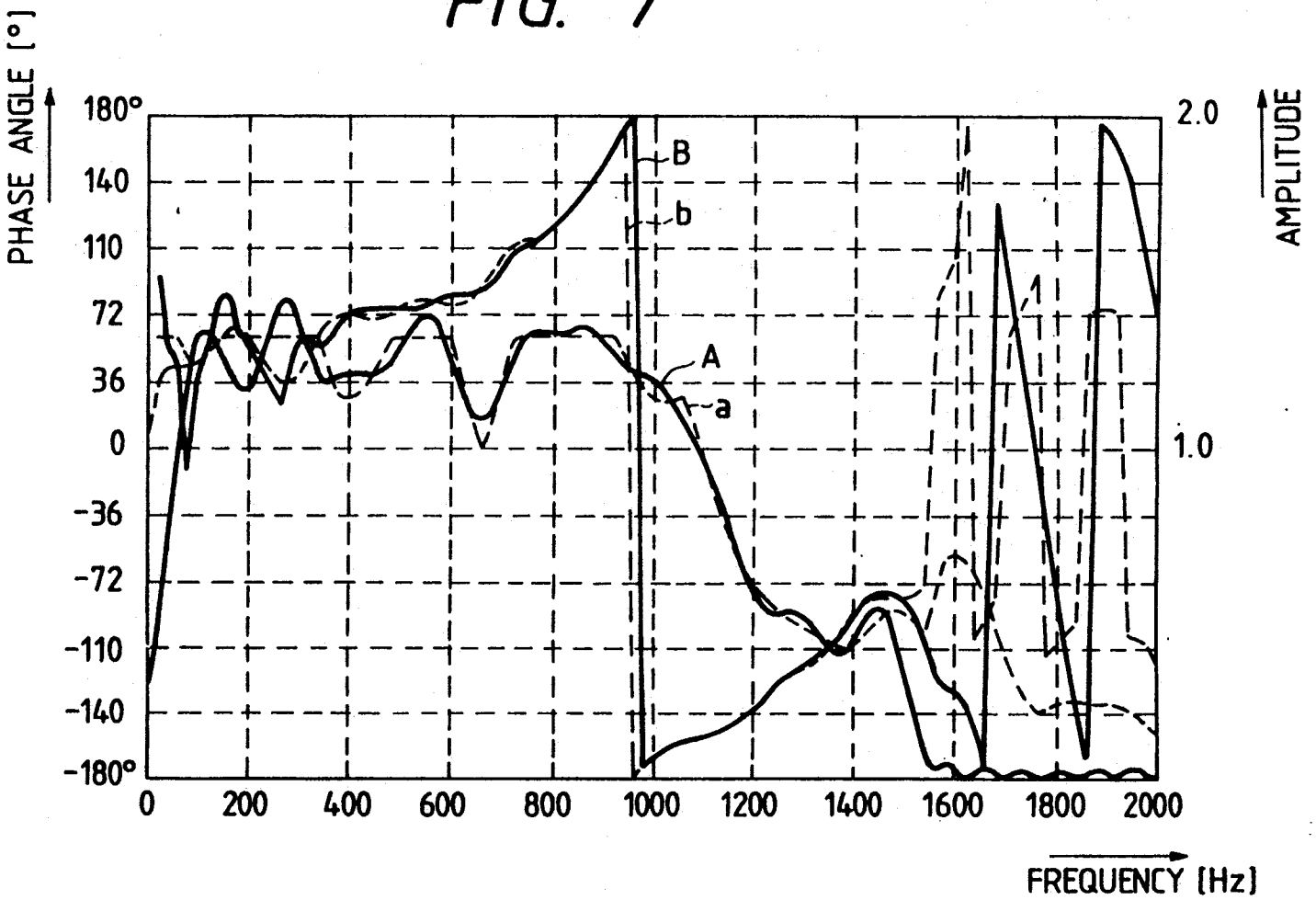
FIG. 7 is a graph diagram showing the frequency responses of a FIR filter (m=3) of the invention and an analog filter.
Figure 8:
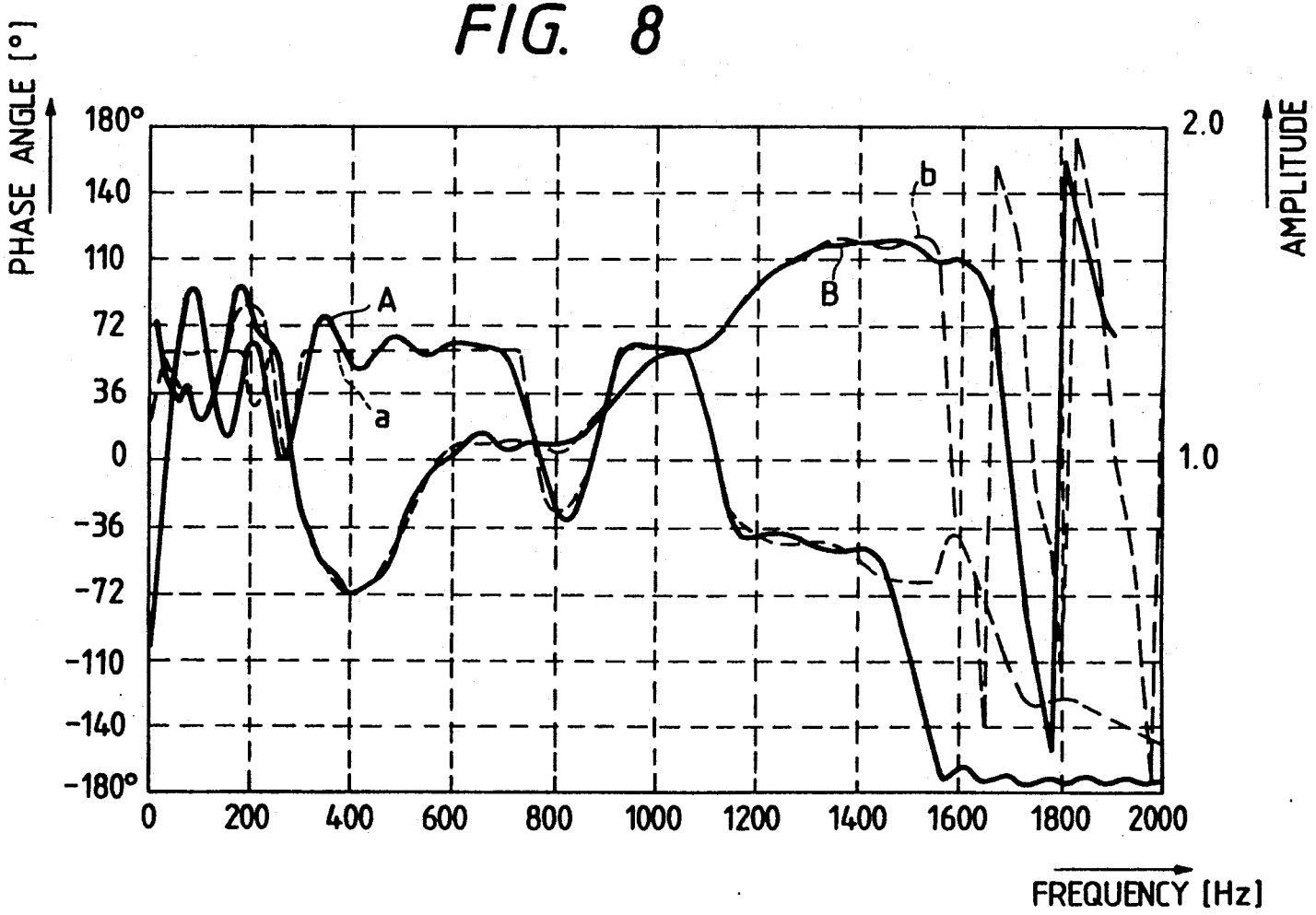
FIG. 8 is a graph diagram showing the frequency responses of a FIR filter (m=4) of the invention and an analog filter.
Figure 9:
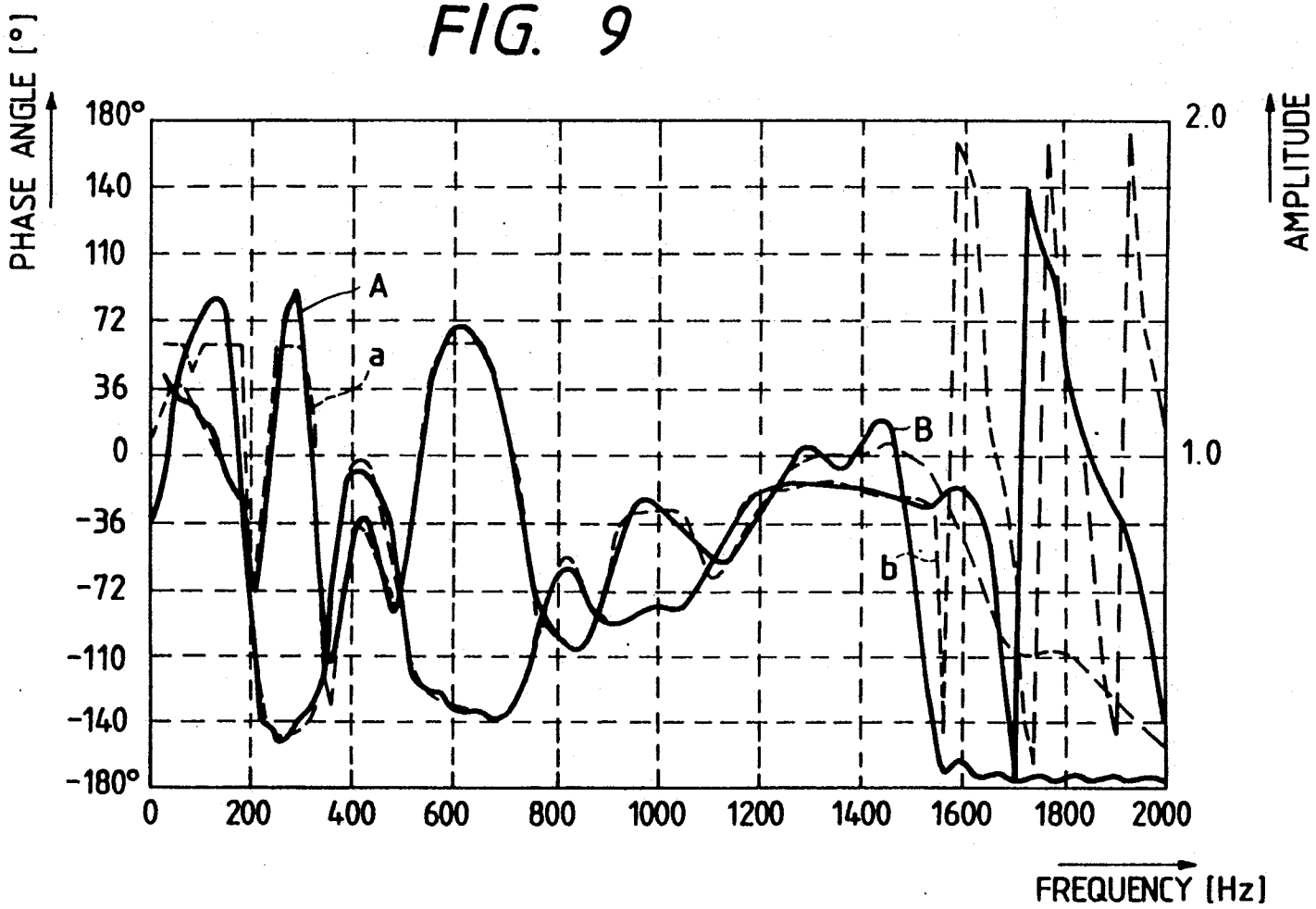
FIG. 9 is a graph diagram showing the frequency responses of a FIR filter (m=5) of the invention and an analog filter.
Figure 10:
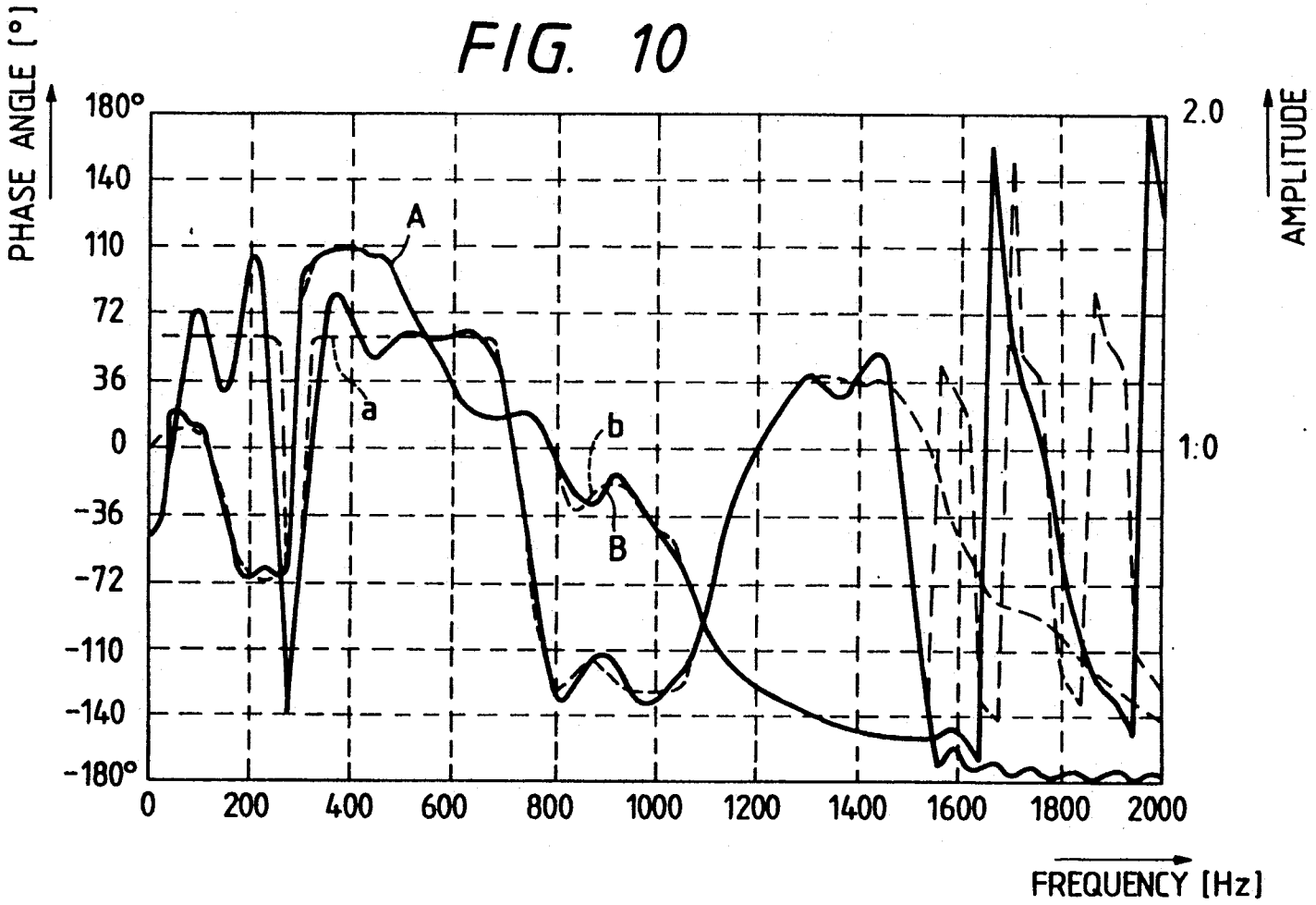
FIG. 10 is a graph diagram showing the frequency responses of a FIR filter (m=6) of the invention and an analog filter.
Figure 11:
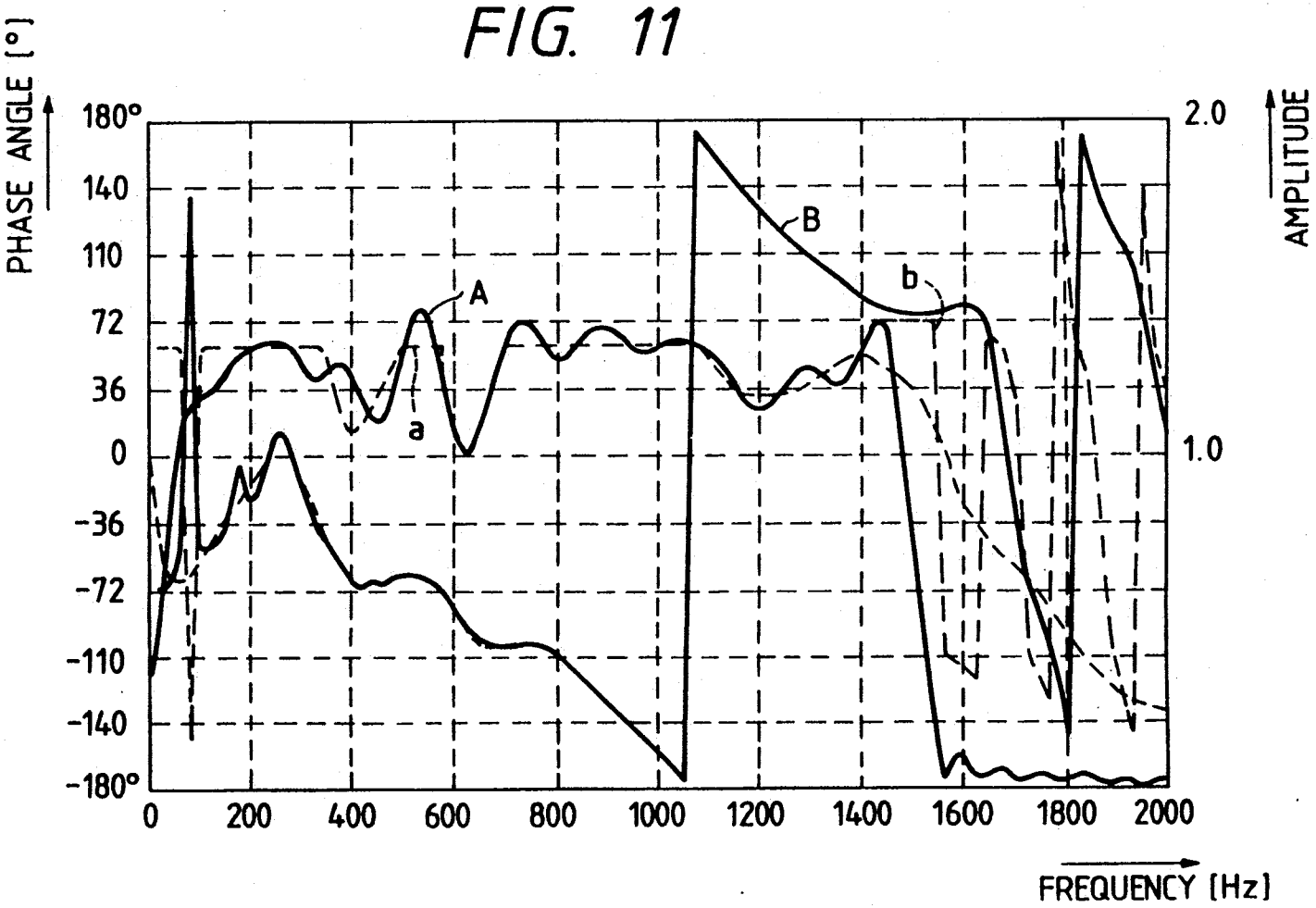
FIG. 11 is a graph diagram showing the frequency responses of a FIR filter (m=7) of the invention and an analog filter.
Figure 12:
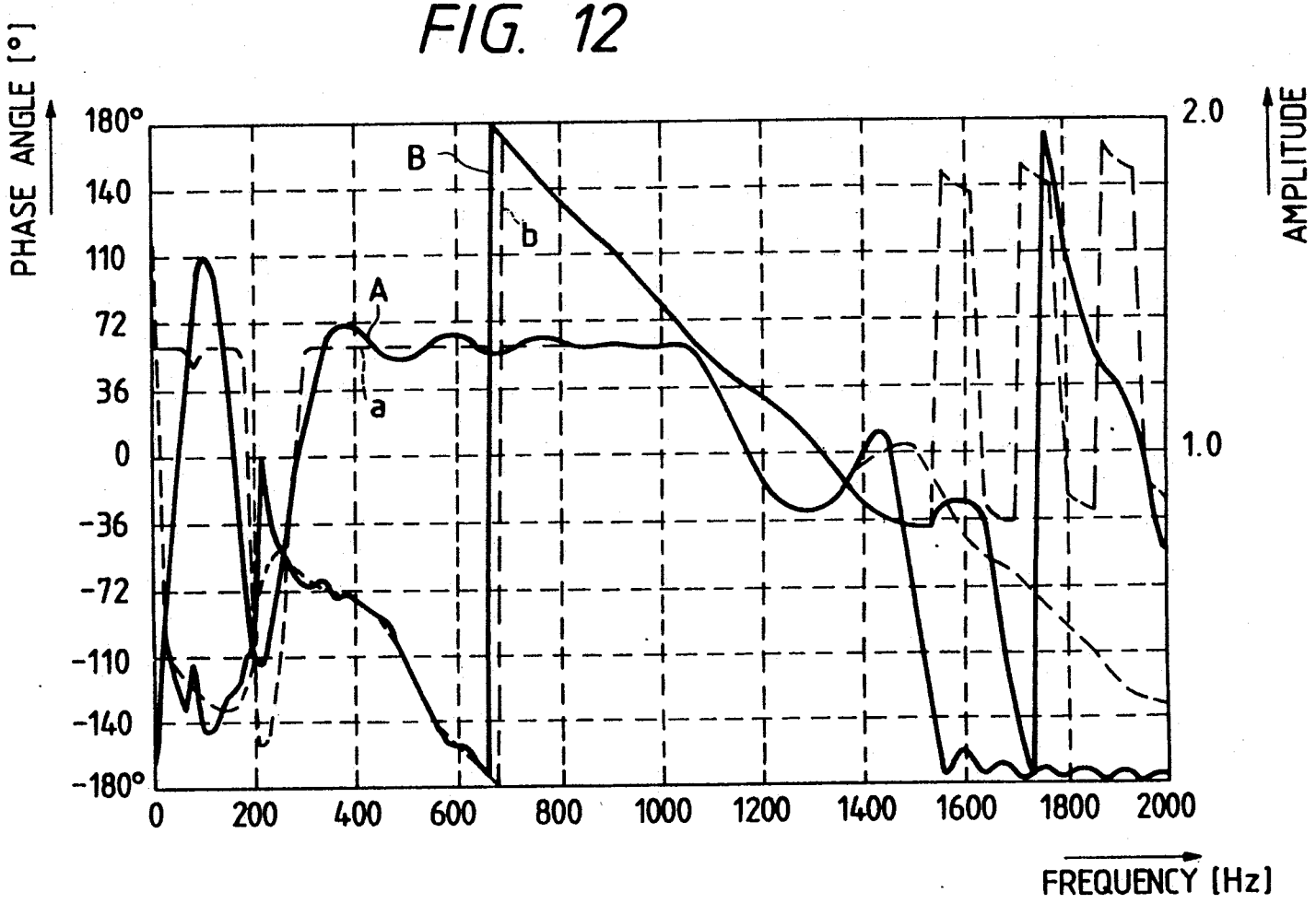
FIG. 12 is a graph diagram showing the frequency responses of a FIR filter (m=8) of the invention and an analog filter.
Figure 13:
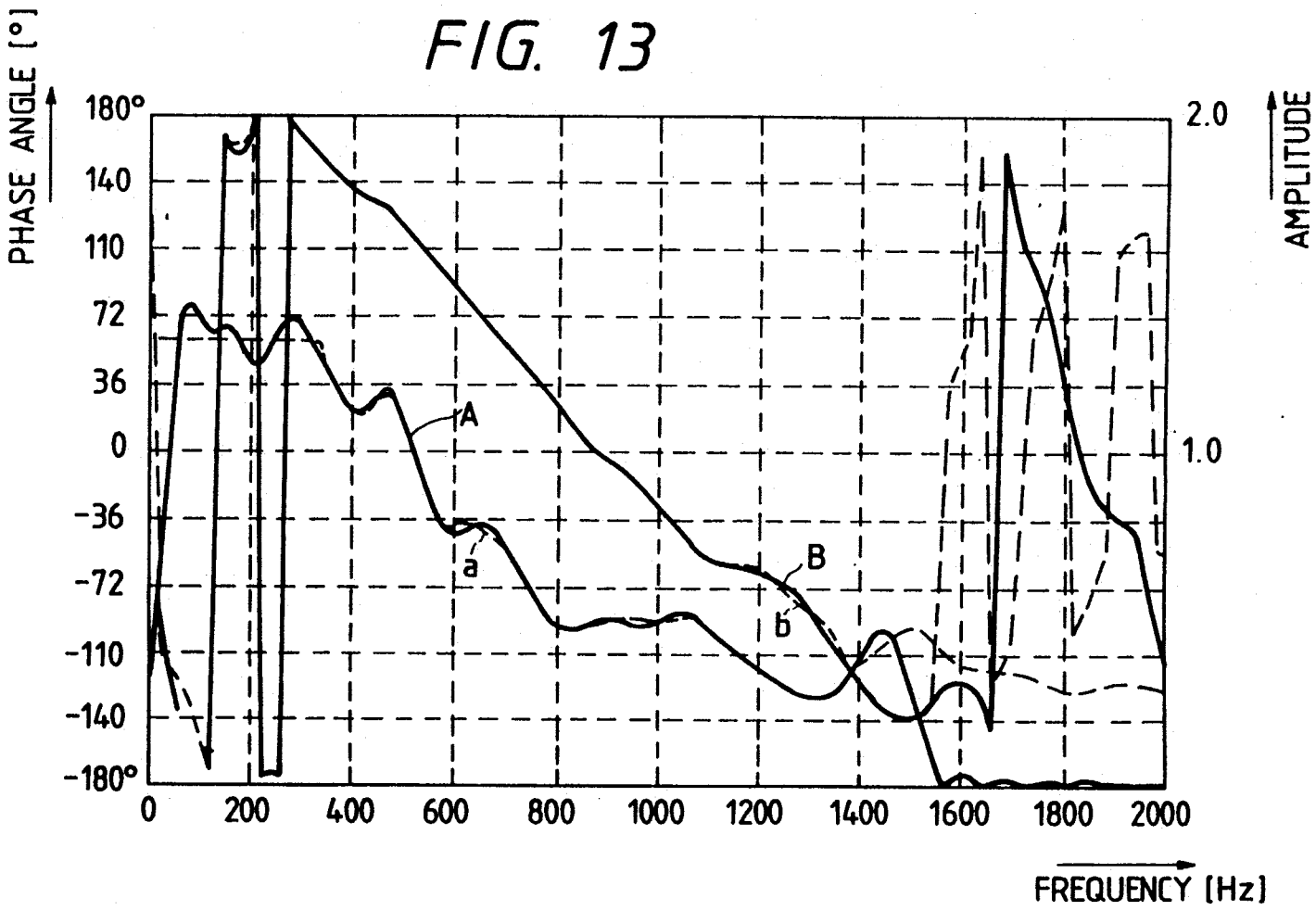
FIG. 13 is a graph diagram showing the frequency responses of a FIR filter (m=9) of the invention and an analog filter.
Figure 14:
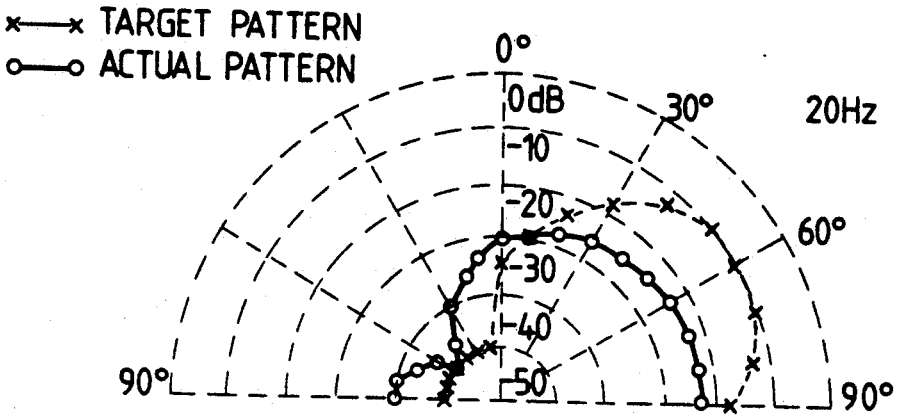
FIG. 14 is a graph diagram showing a two-dimensional directivity pattern at 20 Hz in the speaker system of the first embodiment.
Figure 15:
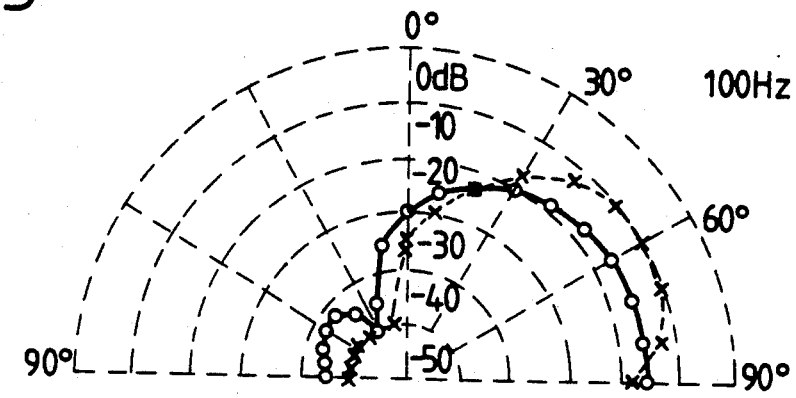
FIG. 15 is a graph diagram showing a two-dimensional directivity pattern at 100 Hz in the speaker system of the first embodiment.
Figure 16:
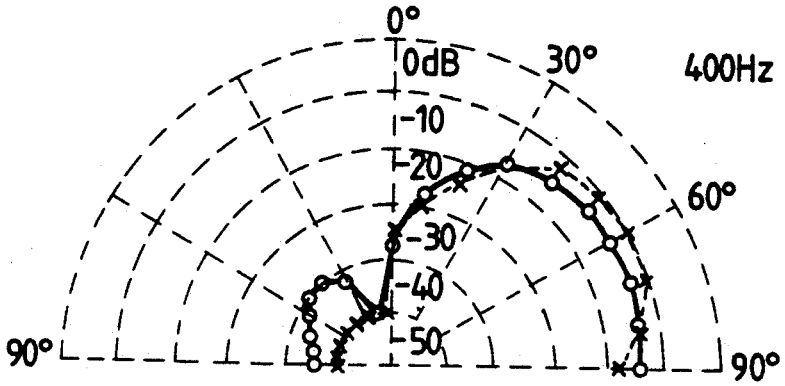
FIG. 16 is a graph diagram showing a two-dimensional directivity pattern at 400 Hz in the speaker system of the first embodiment.
Figure 17:
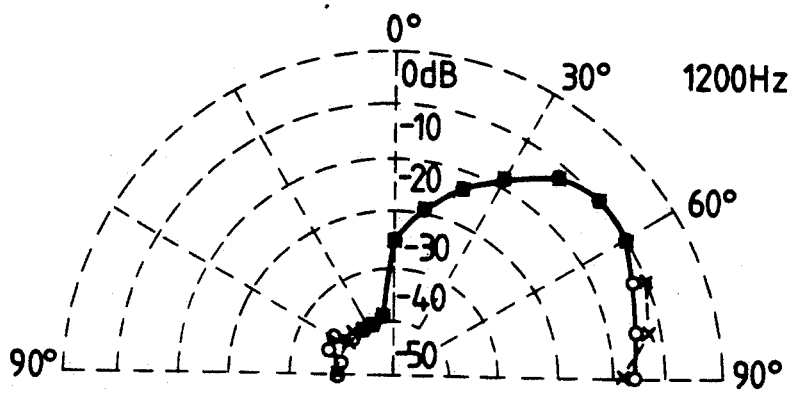
FIG. 17 is a graph diagram showing a two-dimensional directivity pattern at 1200 Hz in the speaker system of the first embodiment.
Figure 18:
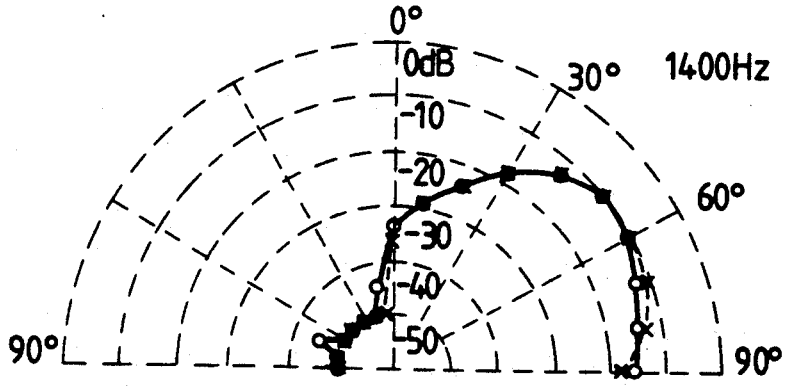
FIG. 18 is a graph diagram showing a two-dimensional directivity pattern at 1400 Hz in the speaker system of the first embodiment.
Figure 19A:
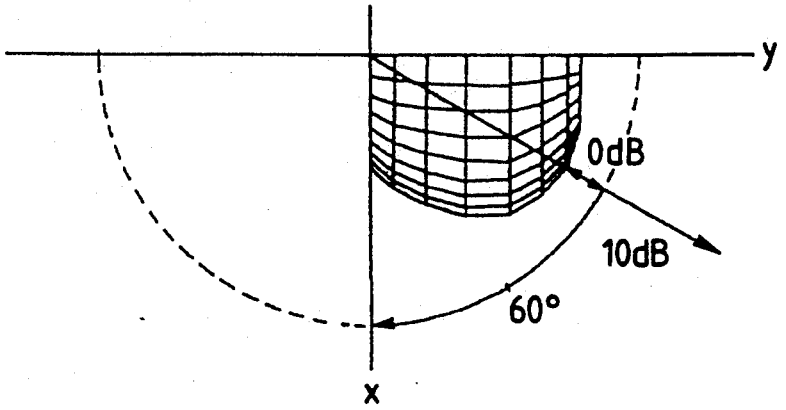
FIGS. 19 (*a*) to (*d*) are graph diagrams showing a target three-dimensional directivity pattern in the speaker system of the first embodiment.
Figure 19B:
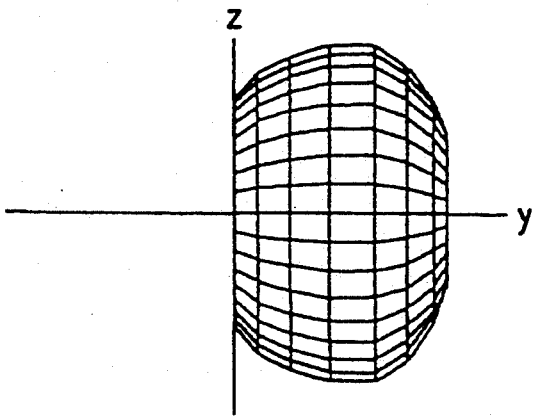
Figure 19C:
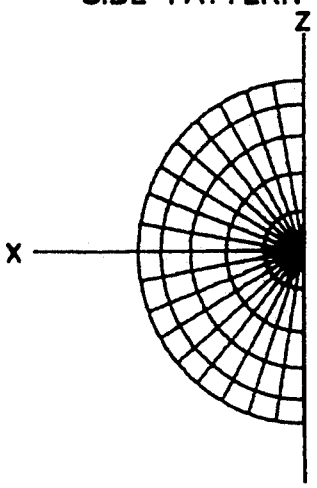
Figure 19D:
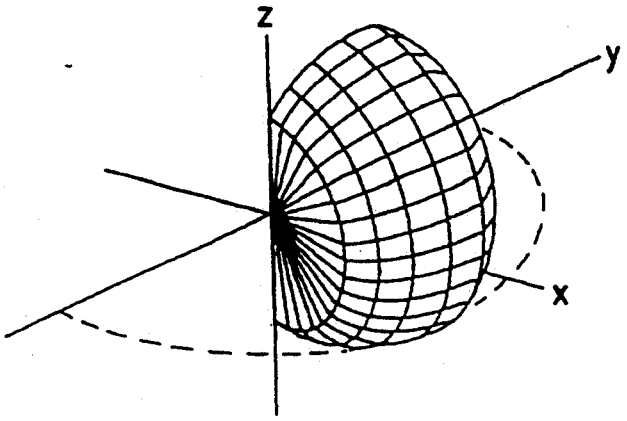
Figure 20A:
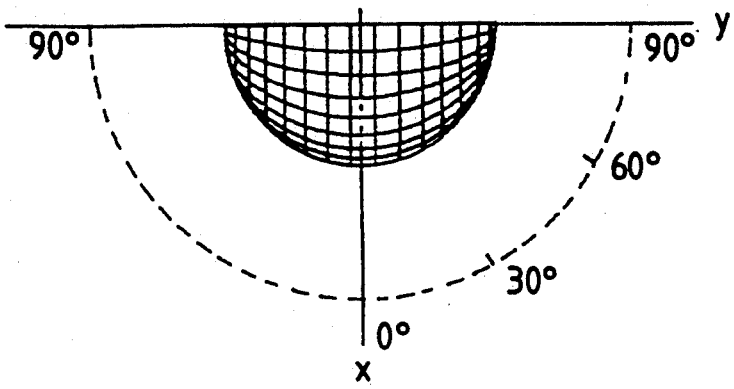
FIGS. 20 (*a*) to (*d*) are graph diagrams showing a three-dimensional directivity pattern at 20 Hz in the speaker system of the first embodiment.
Figure 20B:
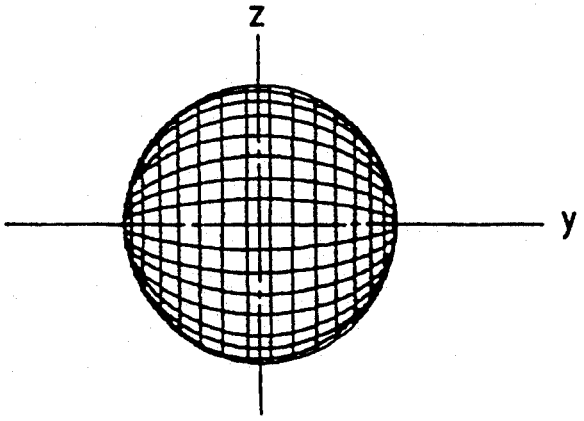
Figure 20C:
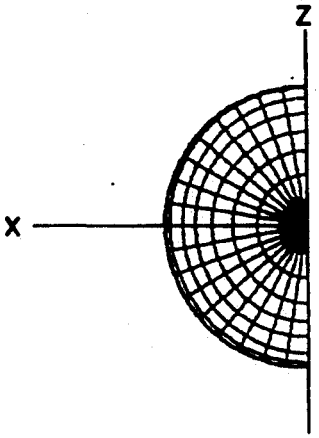
Figure 20D:
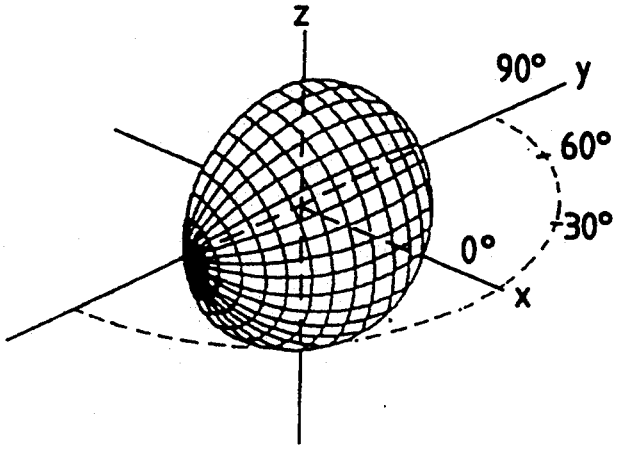
Figure 21A:
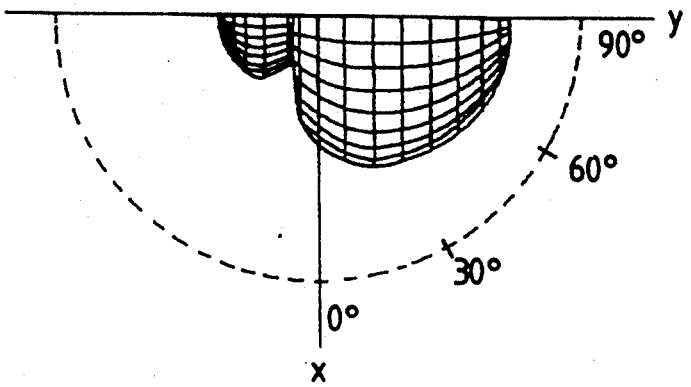
FIGS. 21 (*a*) to (*d*) are graph diagrams showing a three-dimensional directivity pattern at 100 Hz in the speaker system of the first embodiment.
Figure 21B:
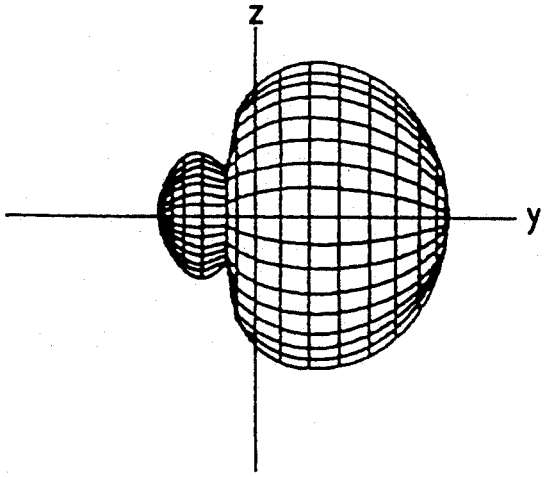
Figure 21C:
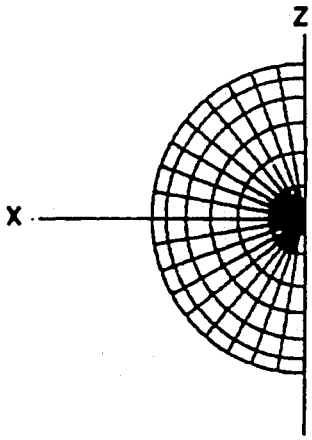
Figure 21D:
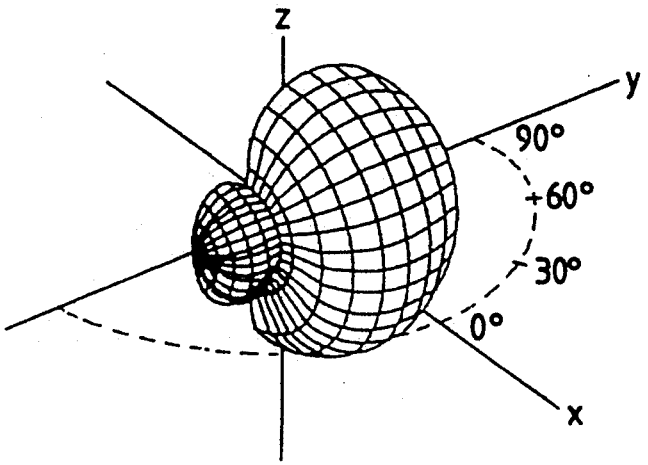
Figure 22A:
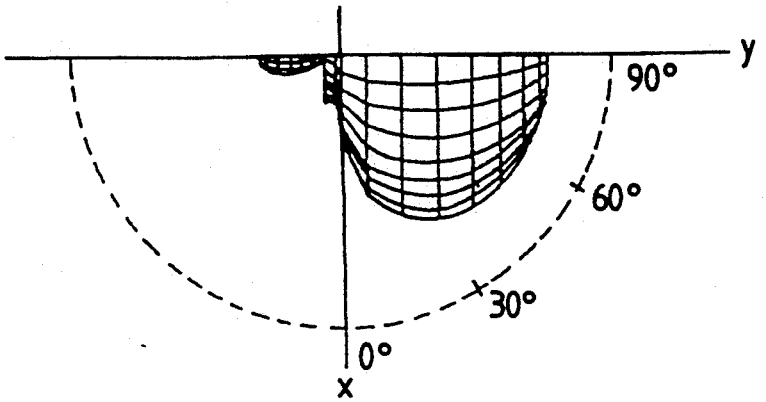
FIGS. 22 (*a*) to (*d*) are graph diagrams showing a three-dimensional directivity pattern at 400 Hz in the speaker system of the first embodiment.
Figure 22B:
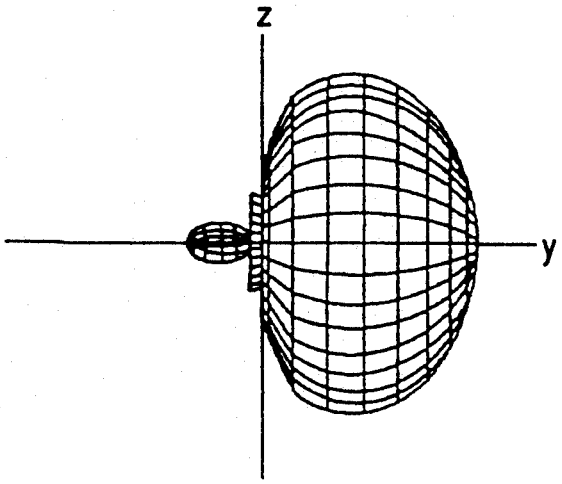
Figure 22C:
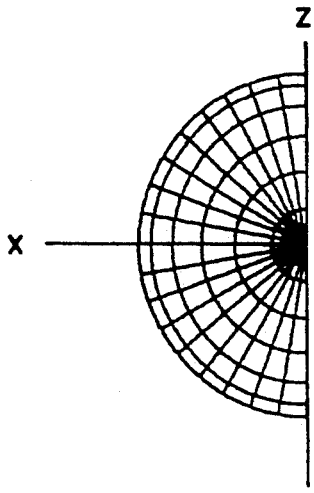
Figure 22D:
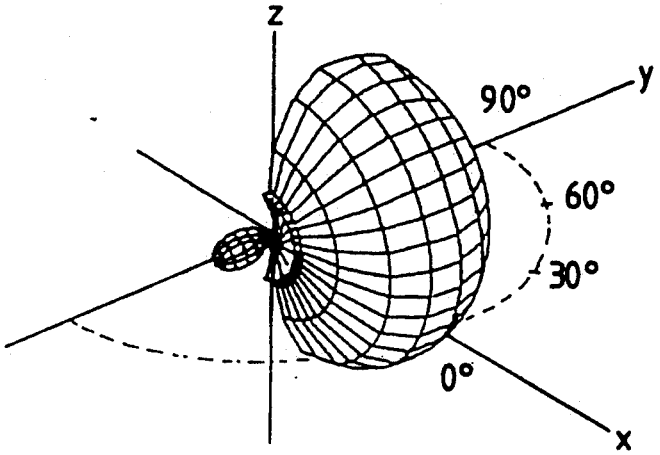
Figure 23A:
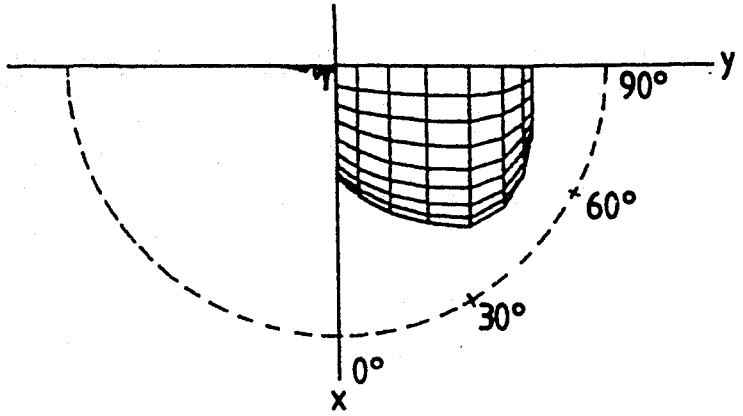
FIGS. 23 (*a*) to (*d*) are graph diagrams showing a three-dimensional directivity pattern at 1200 Hz in the speaker system of the first embodiment.
Figure 23B:
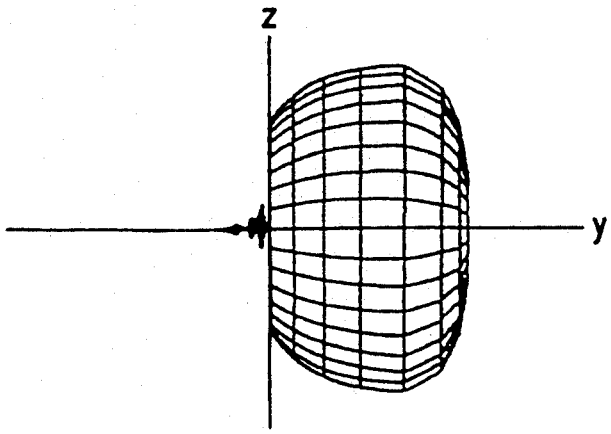
Figure 23C:
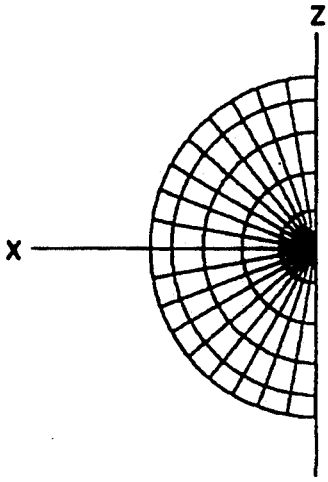
Figure 23D:
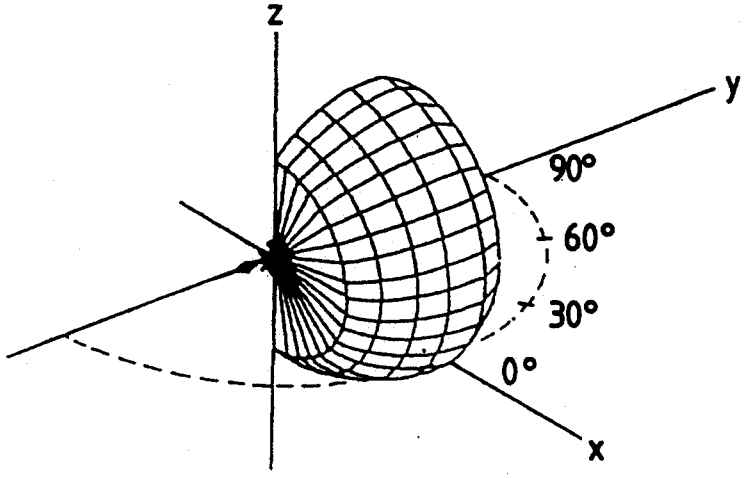
Figure 24A:
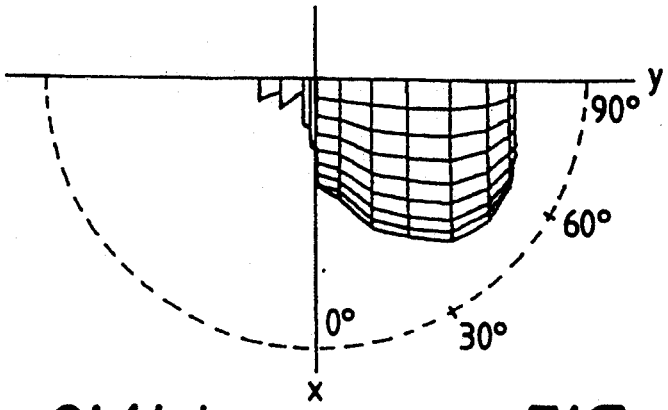
FIGS. 24 (*a*) to (*d*) are graph diagrams showing a three-dimensional directivity pattern at 1400 Hz in the speaker system of the first embodiment.
Figure 24B:
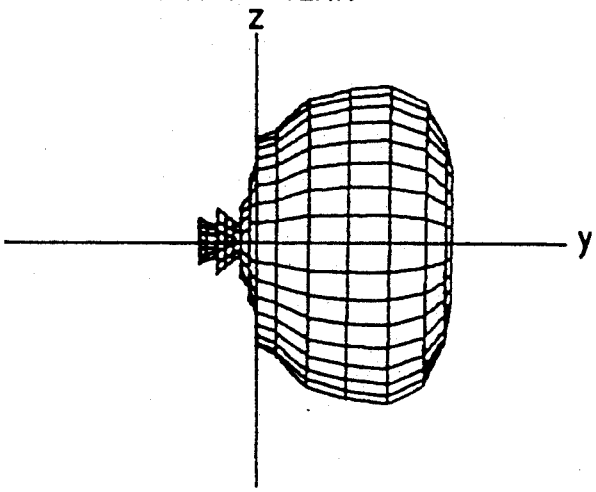
Figure 24C:
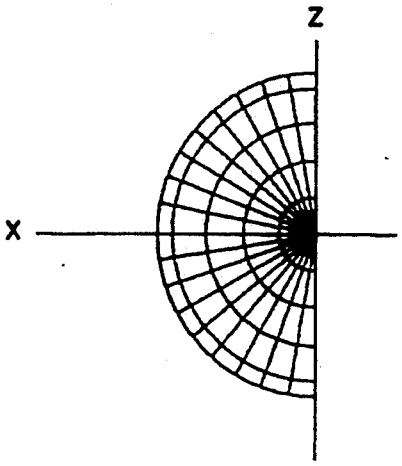
Figure 24D:
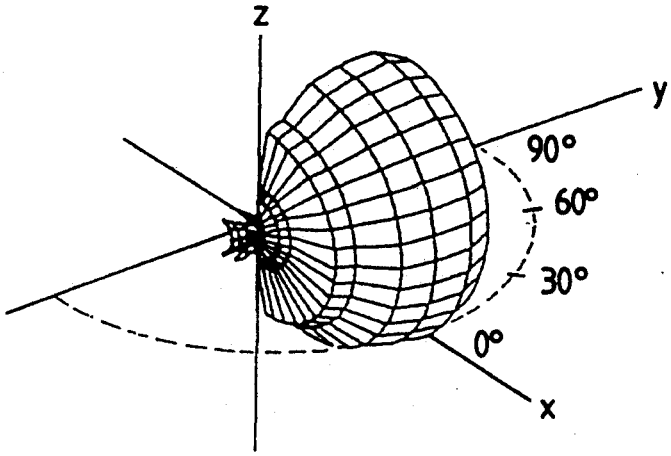

The actual directivity Hyn (ω) can be expressed by the following equation (2) (Step 105 in FIG. 3)

$$Hyn(\omega) = \sum_{m=1}^{M} Hfm(\omega) \cdot Hsmn(\omega) \tag{2}$$

where HFm (ω) is the transfer function of an m-th digital filter; and Hsmn (ω) is the transfer function from the output terminal of an m-th digital filter to the microphone at an n-th measuring point).

In order to determine whether the actual directivity Hyn (ω) either corresponds to or is approximated to a target directivity, an evaluation function f (ω) is set. The evaluation function f (ω) can be expressed by the following equation (3).

$$f(\omega) = \sum_{n=1}^{N} Ci\,\{|Hyn(\omega)| - Gi\}^2 \tag{3}$$

where Ci is the weighing coefficient, which is to be set to an arbitrary value at the time of measurement (Step 101 in FIG. 3), the degree of approximation being increased with larger weighing coefficient Ci; Gi is the target sound pressure value [dB] at a measuring point i; i.e., the target sound pressure value corresponding to a target directivity). The target sound pressure value Gi is a value to be preset so that a target directivity pattern can be formed with respect to each measuring point n=1 to N (Step 100 in FIG. 3).

Since the calculation of optimal filter coefficients for implementing a target directivity pattern involves optimizing or minimizing the evaluation funciton f (ω), an actual directivity Hyn (ω) that minimizes the evaluation function f (ω) is calculated (Steps 105, 106, 107 in FIG. 3). The calculation method to be employed is a nonlinear optimization method. In this regard, the "Broydon-Flether-Goldfarb-Shammo method" or the "Davidon- Fletcher Powell method" is preferably used as the nonlinear optimization algorithm although other such known algorithms can be employed.

Since the weighing coefficient Ci and the target sound pressure value Gi required for the calculation are provided in advance in equation (3) (Steps 100, 101 in FIG. 3), the actual directivity Hyn ($\omega$) must first be calculated from the transfer function Hfm ($\omega$) of the digital filter and the transfer function Hsmn ($\omega$) of the speaker and its radiation space.

The transfer function Hfm ($\omega$) of a digital filter is expressed by the following equation.

$$Hfm\ (\omega) = Rmax\ (\omega) \cdot \sin\ (Xm\ (\omega)) \cdot \exp\ (j\theta m\ (\omega)) \quad (4)$$

where

RMax ($\omega$): maximum amplitude of Hfm ($\omega$) [Rmax ($\omega$)=2×r/m ]

r: distance between the speaker and the measuring point

Xm ($\omega$): parameter $\theta$m ($\omega$): phase of Xm ($\omega$) and Hfm ($\omega$)

The transfer function Hsmn ($\omega$) of the speaker and the radiation space can be calculated as an approximation by a piston motion model of a circular diaphragm in an infinite rigid wall, once the diameter a, location, and measuring point of a speaker unit are defined. A sound pressure P (r, $\theta$) from the circular diaphragm can be given by the following equation.

$$P\ (r,\theta) = \frac{2J\ (ka \sin \theta)}{ka \sin \theta} \cdot \frac{\exp\ (jkr)}{r} \quad (5)$$

where

J: Bessel function

K: wavelength constant (sound speed/angular frequency)

a: diameter of a speaker unit

The sound pressure P (r,$\theta$) calculated by equation (5) (Step 105 in FIG. 3) is used as the transfer function Hsmn ($\omega$) of the speaker and the radiation space (Step 103 in FIG. 3).

Since the transfer function Hfm ($\omega$) obtained by equation (4) (Step 104 in FIG. 3) is a frequency transfer function, it is subjected to an inverted fast Fourier transform ($FFT^{-1}$) process to be converted into an impulse response h($_t$) (Step 108 in FIG. 3).

Figure 4:
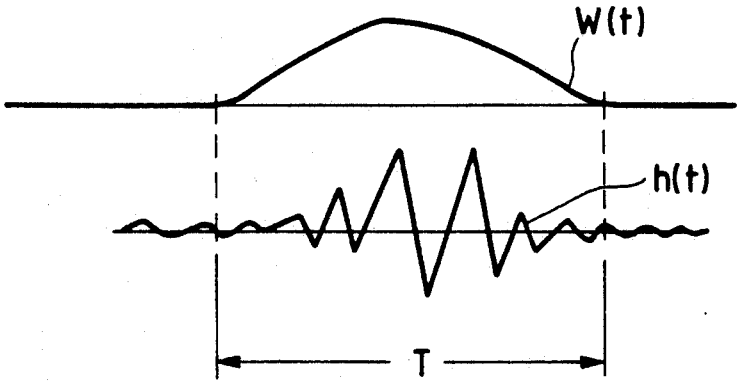
FIG. 4 is a graph diagram illustrative of a Hanning window.

Then, as shown in FIG. 4, the impulse response h(t) is processed with a window W(t), such as a Hanning window (Step 109 in FIG. 3). The time length T of the window W(t) is $$T = L \cdot \Delta t \quad (6)$$

where L is the tap length of an FIR filter, and $\Delta t$ is the sampling time.

The pulse response h(t) thus processed is sampled at an interval $\Delta t$, and the sampled value (amplitude) is multiplied by an appropriate coefficient $\alpha$ to obtain the coefficient $\alpha$hi (Step 110 in FIG. 3), where i=1 to L. This signal processing is performed to prevent aggravation of errors due to impairment of the S/N ratio with the impulse response h(t) overflowing or being too small.

The coefficients $\alpha$hi obtained are set to the respective digital filters (Steps 111, 112 in FIG. 3).

The above operations are performed for each of the measuring point n=1 to N and the obtained filter coefficients $\alpha$hi are set to the respective digital filters $DF_1$ to $DF_m$.

When a signal is applied from the controller 1 to the speaker units $SP_1$ to $SP_m$ through the digital filters $DF_1$ to $DF_m$ to which the filter coefficients $\alpha$hi have been set, a desired directivity pattern can be obtained from the speaker array.

Exemplary frequency response characteristics of the respective digital filters $DF_1$ to $DF_m$ in the case where the filter coefficients $\alpha$hi obtained by the above-mentioned operations are set to the respective digital filters $DF_1$ to $DF_m$ are shown in FIGS. 5 to 13. In these examples, the number of speaker units used to form a speaker array is 9, with the corresponding digital filters being designated as m (m =1 to 9). In each of FIGS. 5 to 13, reference character A designates the amplitude characteristic of an FIR filter; B, the phase characteristic of the FIR filter, while the amplitude characteristic a and phase characteristic b of an analog filter are additionally indicated for reference.

Using the digital filters $DF_1$ to $DF_m$ having the characteristics shown in FIGS. 5 to 13, two-dimensional (xy plane) directivity patterns of a sound signal fed to the common input signal terminal IN are shown in FIGS. 14 to 18 by frequency. In each of FIGS. 14 to 18, reference symbol . . x . . . x . . . designates a target pattern; and reference symbol . . . ∘. . . ∘. . . , an actual pattern. As is understood from these figures, a directivity corresponding to a desired directivity was obtained over a range covering a low frequency (20 Hz) to a medium frequency (1400 Hz), although some side lobes appear.

Further, to facilitate the understanding, directivity patterns of a speaker array observed three-dimensionally from the same frequency parameters are shown in FIGS. 19 to 24, the speaker array consisting of the same 9 linearly arranged speaker units. As is understood from the respective figures, each pattern exhibits a directivity in a direction of about 45° on the xy plane and showing a consistent, semispherical distribution in the z-axis direction.

Figure 25:
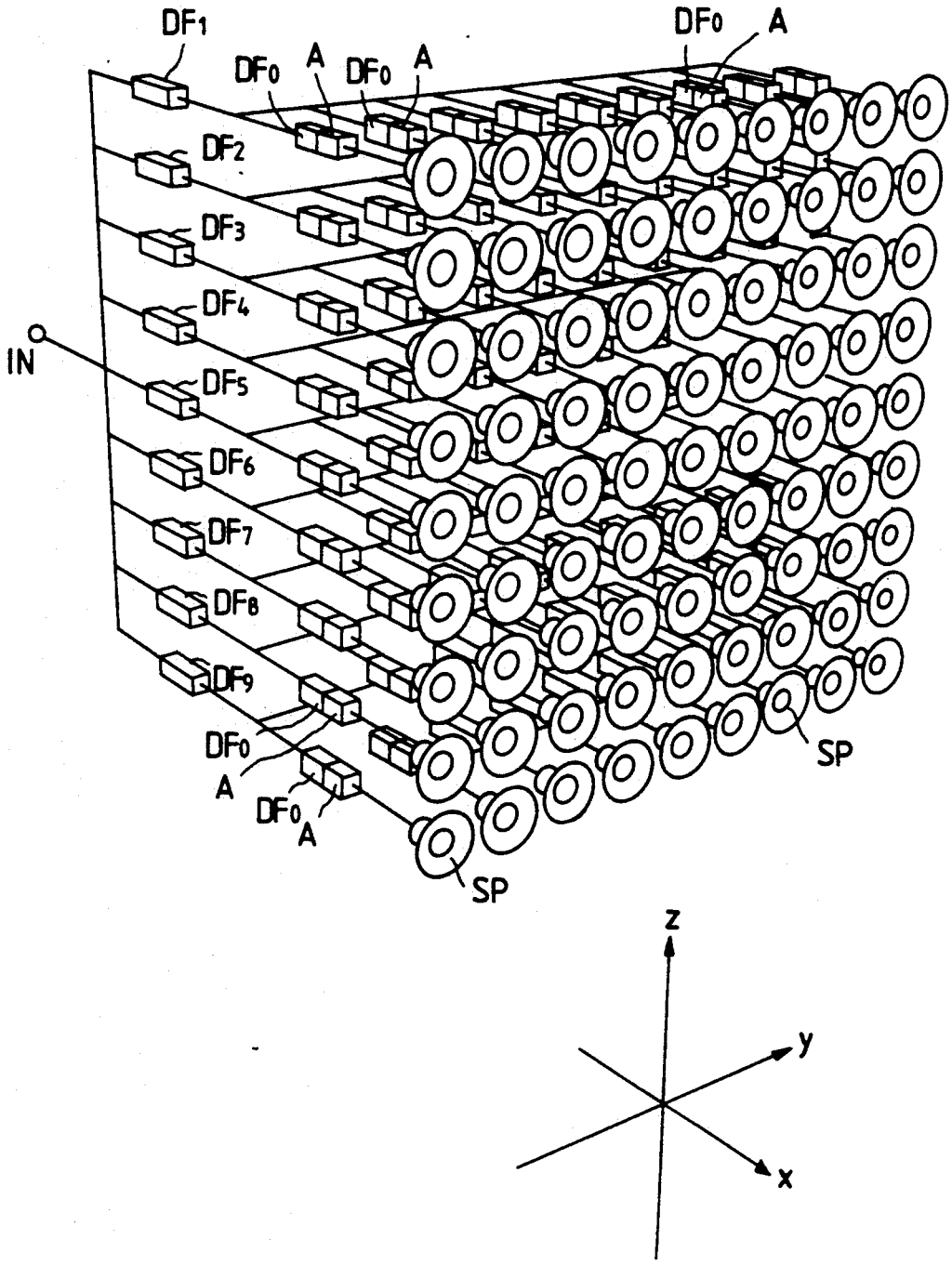
FIG. 25 is a perspective view showing the appearance of a two-dimensionally arranged speaker system, which is a second embodiment of the invention.
Figure 26A:
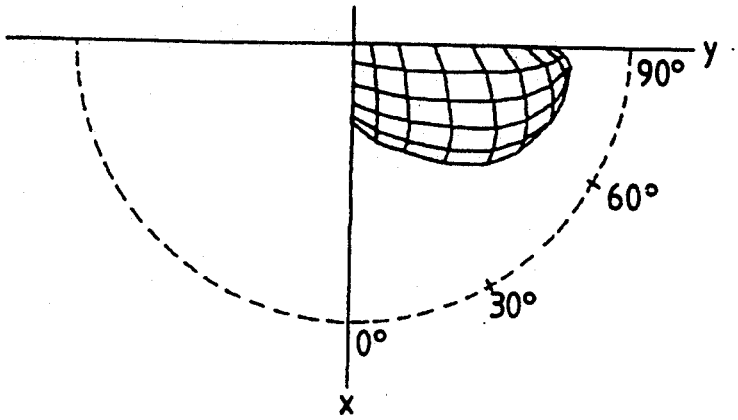
FIGS. 26 (*a*) to (*d*) are graph diagrams showing a target three-dimensional directivity pattern in the speaker system of the second embodiment.
Figure 26B:
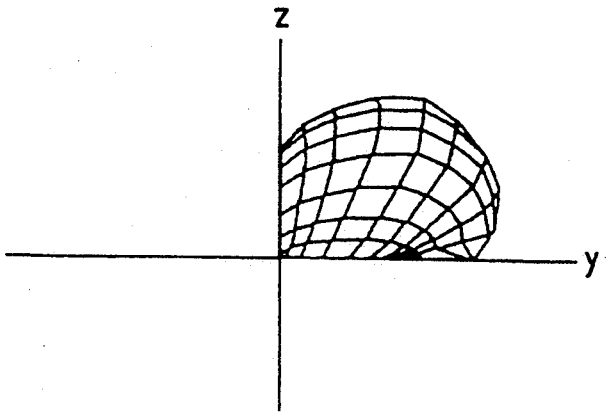
Figure 26C:
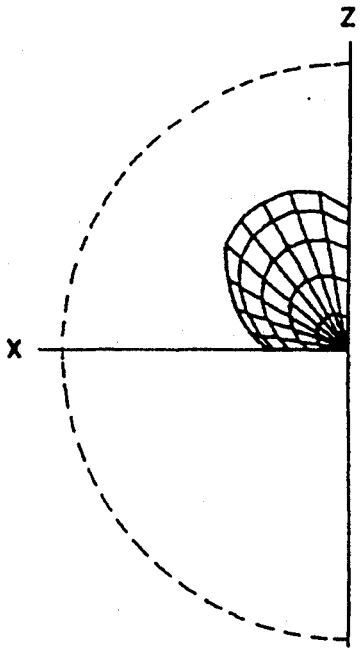
Figure 26D:
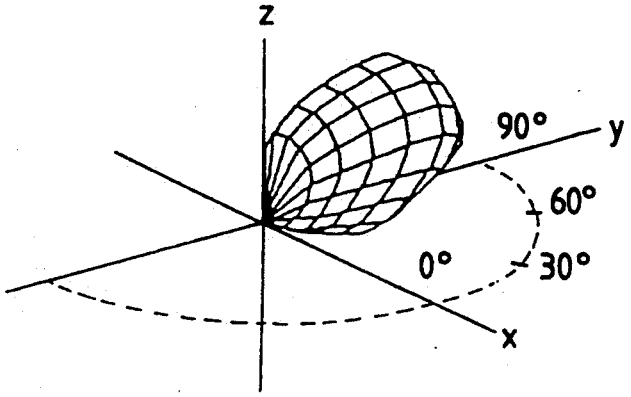
Figure 27A:
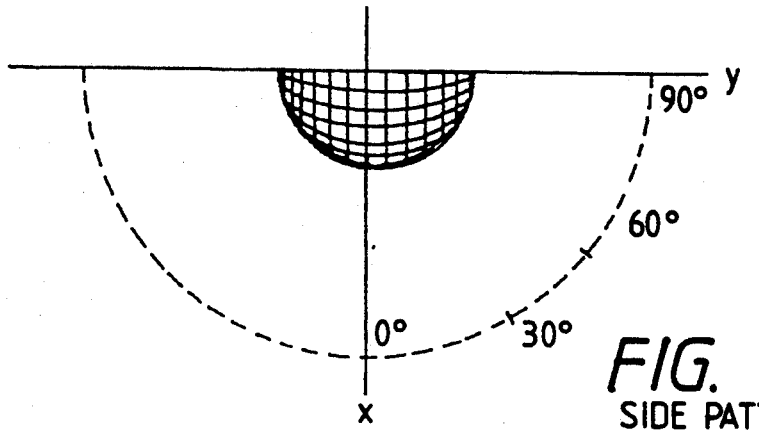
FIGS. 27, (*a*) to (*d*) are graph diagrams showing a target three-dimensional directivity pattern at 20 Hz in the speaker system of the second embodiment.
Figure 27B:
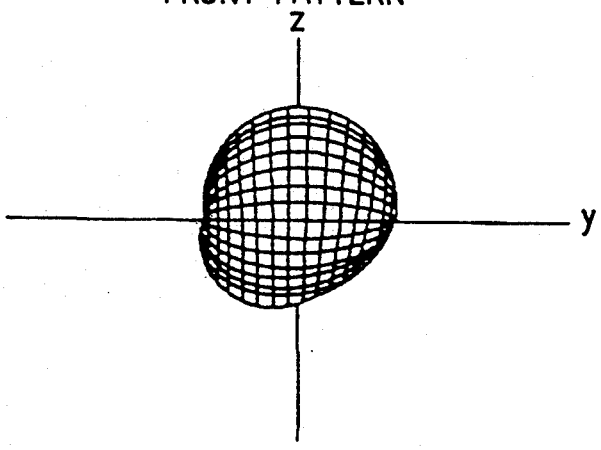
Figure 27C:
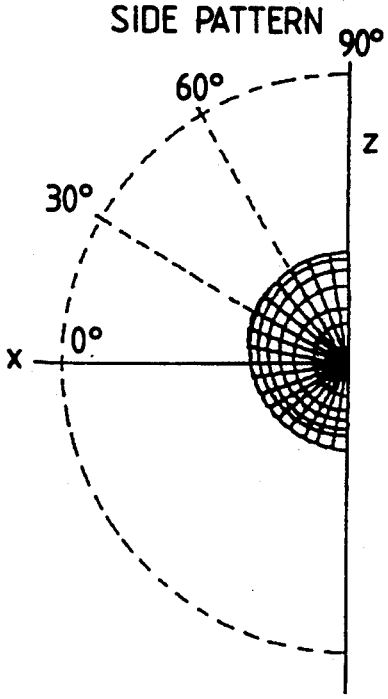
Figure 27D:
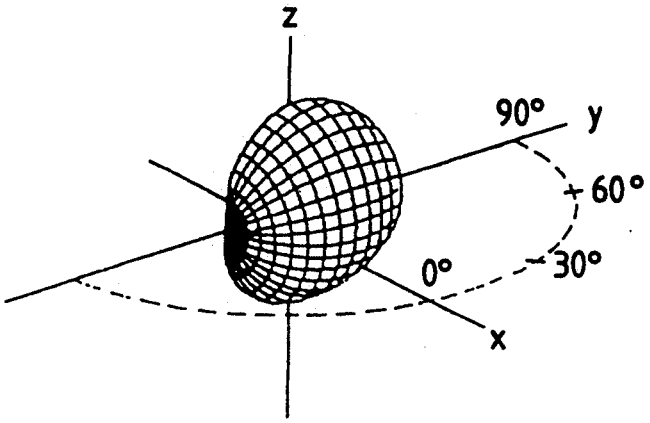
Figure 28A:
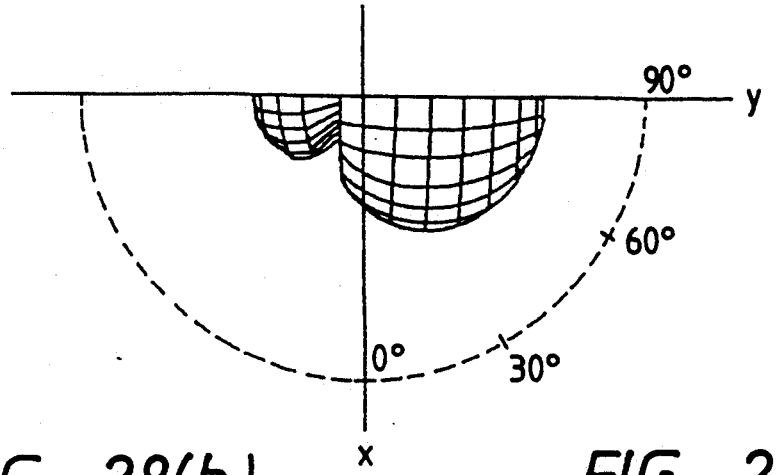
FIGS. 28 (*a*) to (*d*) are graph diagrams showing a target three-dimensional directivity pattern at 100 Hz in the speaker system of the second embodiment.
Figure 28B:
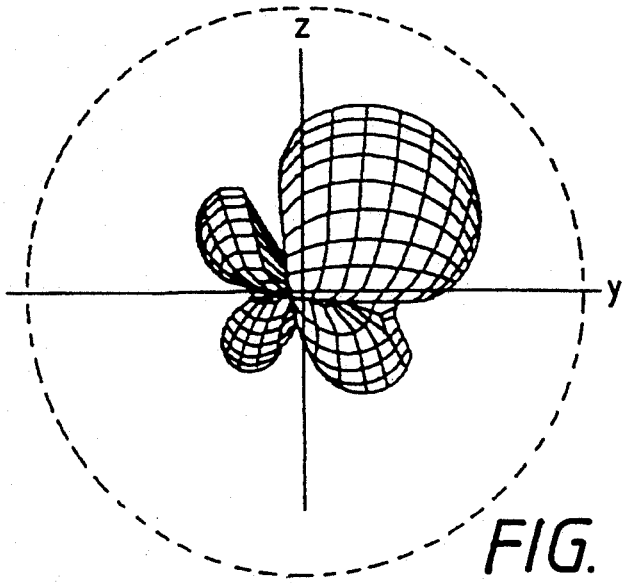
Figure 28C:
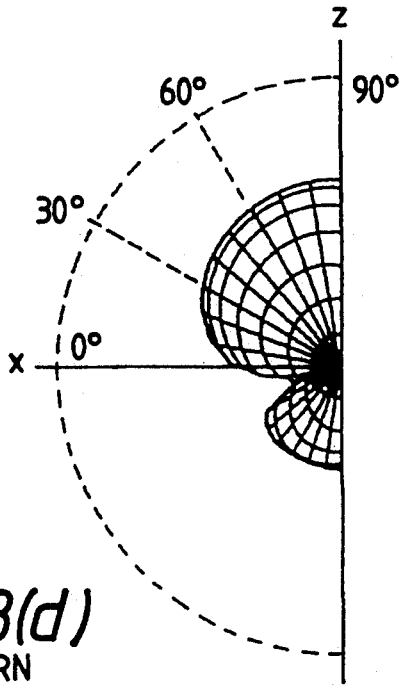
Figure 28D:
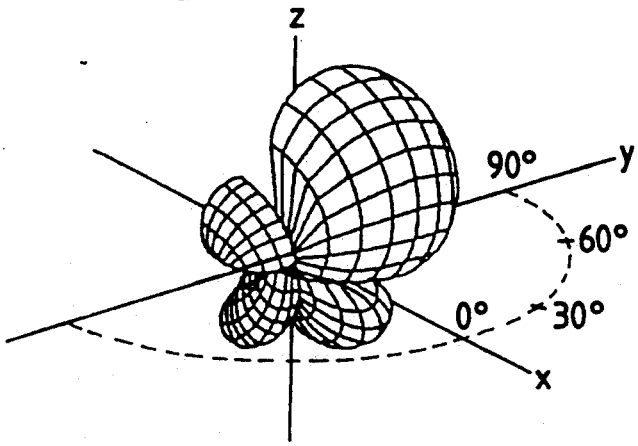
Figure 29A:
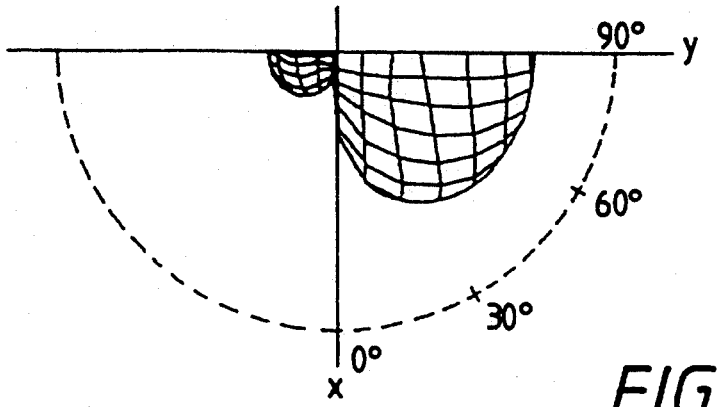
FIGS. 29 (*a*) to (*d*) are graph diagrams showing a target three-dimensional directivity pattern at 400 Hz in the speaker system of the second embodiment.
Figure 29B:
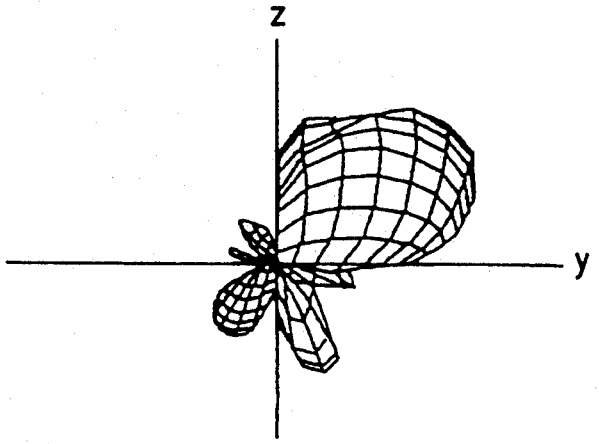
Figure 29C:
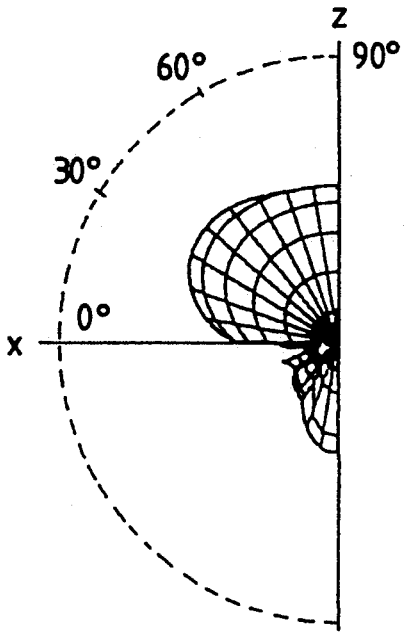
Figure 29D:
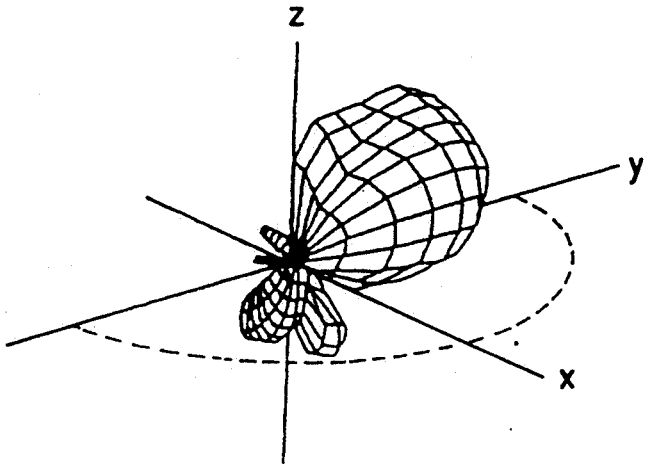
Figure 30A:
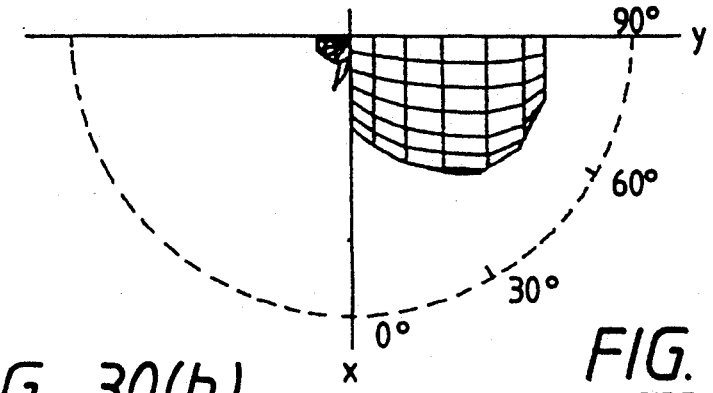
FIGS. 30 (*a*) to (*d*) are graph diagrams showing a target three-dimensional directivity pattern at 1200 Hz in the speaker system of the second embodiment.
Figure 30B:
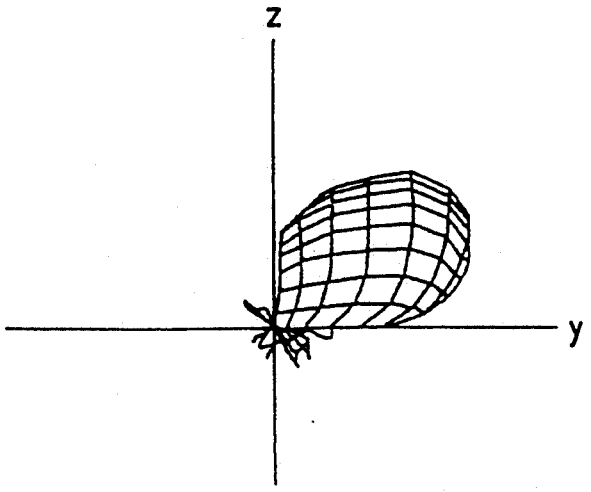
Figure 30C:
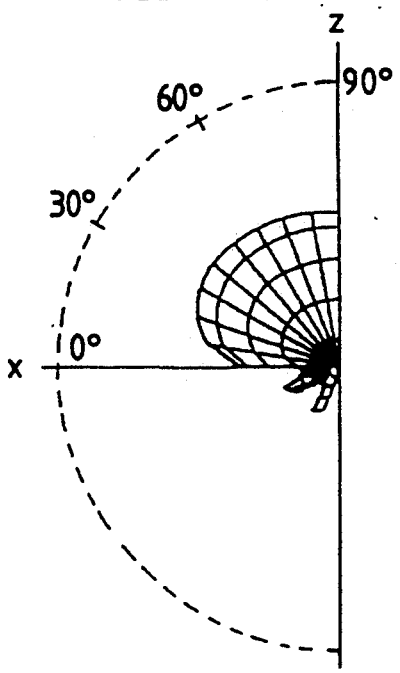
Figure 30D:
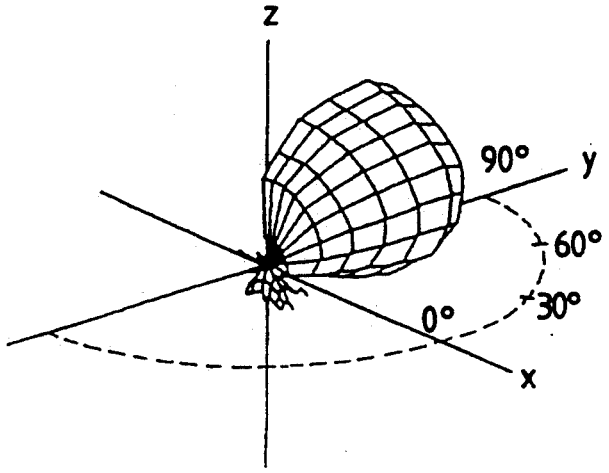
Figure 31A:
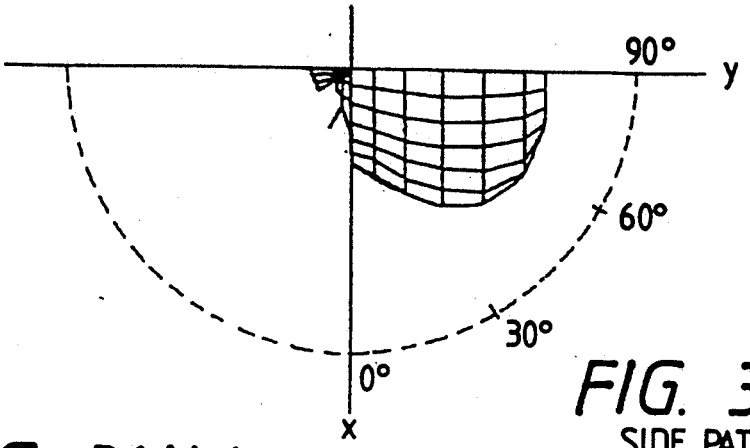
FIGS. 31 (*a*) to (*d*) are graph diagrams showing a three-dimensional directivity pattern at 1400 Hz in the speaker system of the second embodiment.
Figure 31B:
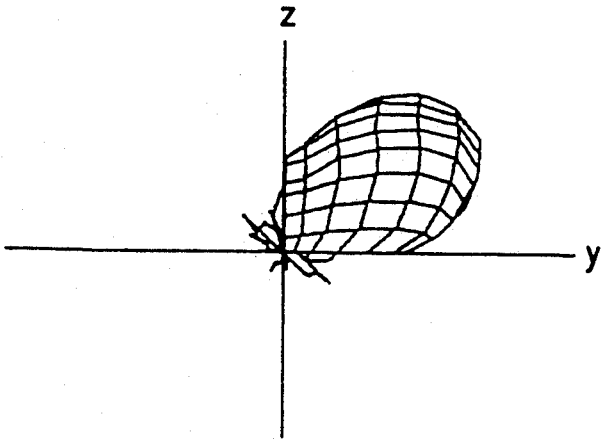
Figure 31C:
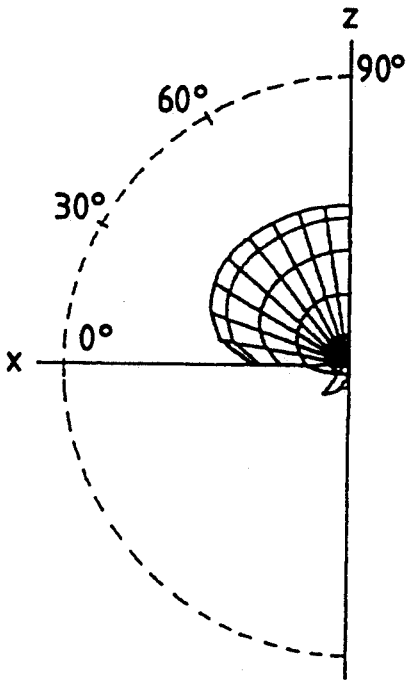
Figure 31D:
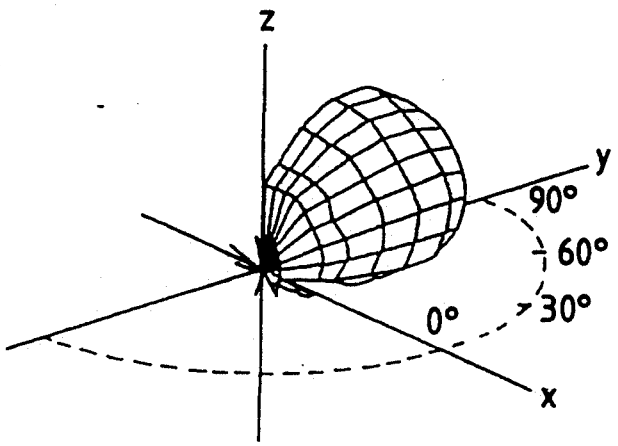

A speaker system, which is a second embodiment of the invention, is shown in FIGS. 25 to 31. This embodiment is an example in which the invention is applied to a speaker array consisting of a plurality of speaker units arranged in matrix form (or in lattice form). As shown in FIG. 25, the speaker system has a single common input signal terminal IN, and this common input signal terminal IN is branched into a plurality of speaker units $SP_1$ to $SP_m$ so that each of the speaker units $SP_1$ to $SP_m$ can be driven in parallel. As shown in FIG. 25, digital filters $DF_1$ to $DF_m$ are inserted on the signal lines of the respective branch paths reaching the speaker units $SP_1$ to $SP_m$ so as to correspond to the speaker units $SP_1$ to $SP_m$ extending in the vertical direction (in the Z direction), respectively, and digital filters $DF_{01}$ to $DF_{0m}$ and amplifiers $A_1$ to $A_m$ connected to the filters in series are also inserted on the signal paths branched out from the output terminals of the digital filters $DF_1$ to $DF_m$ to the speaker units $SP_1$ to $SP_m$, respectively. Namely, the speaker array as shown in FIG. 2 is arranged in nine rows in the vertical direction (in the z direction), and these arrays are connected to nine digital filters respectively. Although not shown, a controller 1 is connected to the digital filters $DF_1$ to $DF_m$ and $DF_{01}$ to $DF_{0m}$ through a signal line as in the first embodiment (FIG. 1), and filter coefficient data $\alpha$hi stored in a memory 2 are set to the controller 1 by operating an input keyboard 3 through the controller 1.

The speaker units $SP_1$ to $SP_m$ constitute a speaker array while arranged on a plane in matrix form, keeping the same distance from one another in a two-dimensional direction (the yz plane). Similar to the first embodiment, it is preferable that the physical properties of each of the speaker units $SP_1$ to $SP_m$ be equal to one another. The structure of fixing the speaker units may be selected appropriately, depending on the particular application; the speaker units may be disposed in enclosures, which are mounting bodies, or on a wall. Further, the reproducing frequency range may also be designed arbitrarily. In the axes shown in FIG. 25, the x-axis indicates a direction of sound radiation; the y-axis, a direction of width (or a horizontal direction); and the z-axis, a direction of height (or a vertical direction).

For the digital filters $DF_1$ to $DF_m$ and $DF_{01}$ to $DF_{0m}$, direct FIR filters using DSPs are employed as in the first embodiment. The same applies to the amplifiers $A_1$ to $A_m$, using power amplifiers, each of which has an appropriate amplification factor.

A method of controlling directivity is also similar to that of the first embodiment. The filter coefficients $\alpha hi$ are calculated according to the flowchart in FIG. 3 and set to the respective digital filters $DF_1$ to $DF_m$ and $DF_{01}$ to $DF_{0m}$. In this case, the microphones are arranged so as to constitute a spherical surface of which the center is at a position separated from the central position of the speaker array by a predetermined distance.

The frequency responses shown in FIGS. 5 to 13 of the first embodiment will be applied to those of the digital filters $DF_1$ to $DF_m$ and $DF_{01}$ to $DF_{0m}$ in the case where the filter coefficients $\alpha hi$ calculated by the above procedures are set. Here, the speaker system may be constituted with one digital filter and one amplifier for each speaker unit if the properties of the digital filters arranged in the vertical direction (z direction) and the properties of the digital filters arranged in the horizontal direction (y direction) are compounded. In short, eighty-one kinds of filter properties are required for $9\times9$ ($=81$) speaker units.

The directivity control results by a speaker array consisting of a total of 81 speaker units with a $9\times9$ arrangement are shown in FIGS. 26 to 31. These examples are those in which the target directivity appears at about 75° on the xy plane, at about 60° on the yz plane, and at a generally upper right position viewed from front (toward the speaker array). As is understood from the FIGS. 26 to 31, a satisfactory directivity over the range of low frequencies (around 100 Hz) to a middle frequency (1400 Hz) is exhibited, although there appear some side lobes.

Figure 32:
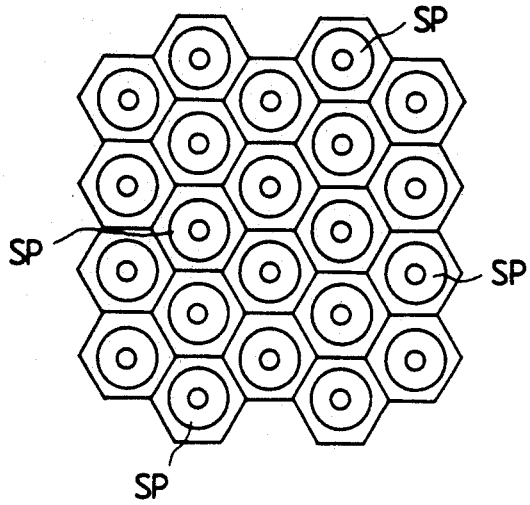
FIG. 32 is a front view showing a part of a speaker system, which is a third embodiment of the invention.
Figure 33:
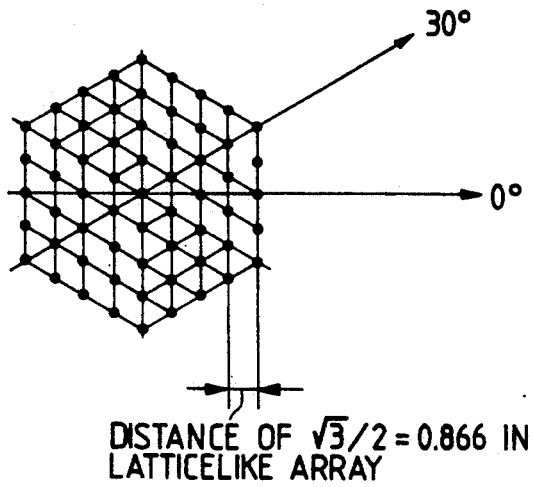
FIG. 33 is a diagram illustrative of an exemplary arrangement of a honeycomb-like speaker array.
Figure 34:
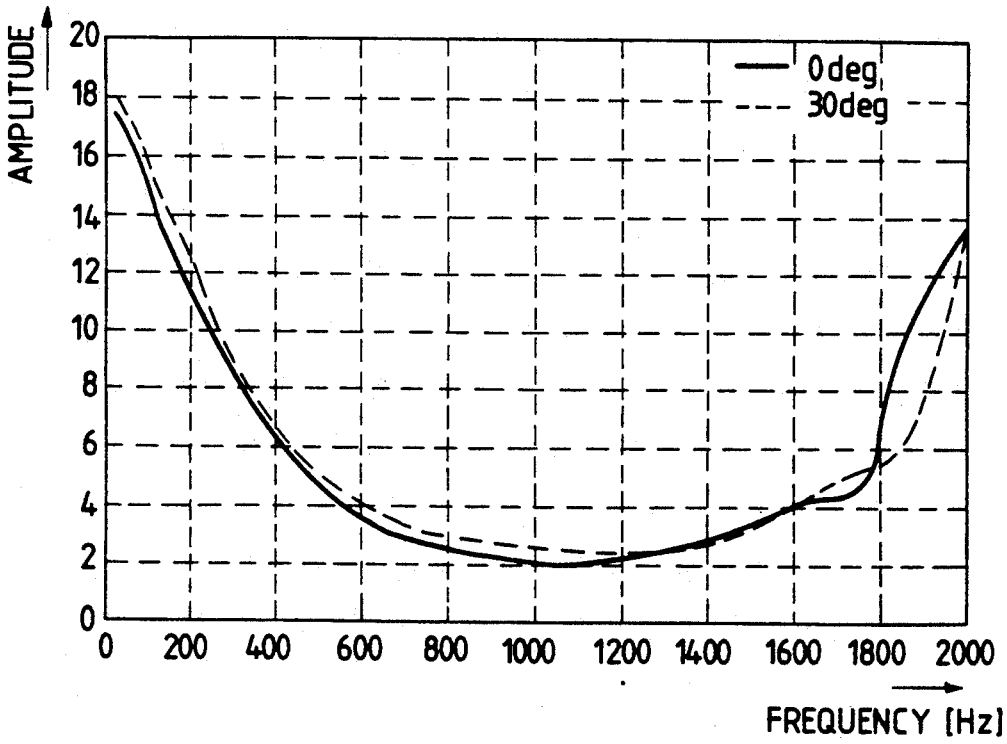
FIG. 34 is a diagram showing the frequency characteristic of an error evaluation function of the honeycomblike speaker array.

A speaker system, which is a third embodiment of the invention, is shown in FIGS. 32 to 34. The feature of this embodiment is that a honeycomb-like speaker array is employed.

That is, as shown in FIG. 32, a plurality of speaker units are arranged so as to be staggered, and as shown in FIG. 33, these speaker units are distributed on each side of multiple hexagons as a whole. The speaker units are respectively connected to digital filters (not shown) each having different property.

Figure 35:
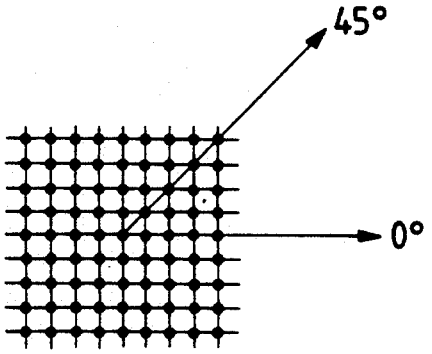
FIG. 35 is a diagram illustrative of an exemplary arrangement of a latticelike speaker array.

In the case of a such honeycomb-like speaker array, the distance between two adjacent speaker units is $\sqrt{3}/2=0.866$ times the distance between two adjacent speaker units of a lattice-like speaker array shown in FIG. 35. The narrowing of the distance between the speaker units means that the speaker array gets closer to a point sound source to such extent of narrowing, and this means, in terms of performance, that the upper limit of frequencies at which the directivity can be controlled is increased, and in terms of shape and dimension, that the size and number of speaker units are reduced. Thus, the honeycomb-like speaker array is more advantageous than the lattice-like speaker array.

FIG. 34 shows an exemplary frequency characteristic of the error evaluation function of a speaker array consisting of a total of 61 speaker units arranged in honeycomb form. As is understood from FIG. 34, the upper limit frequency at which the directivity can be controlled is as high as about 1800 Hz both on the 0° axis and on the 30° axis.

Figure 36:
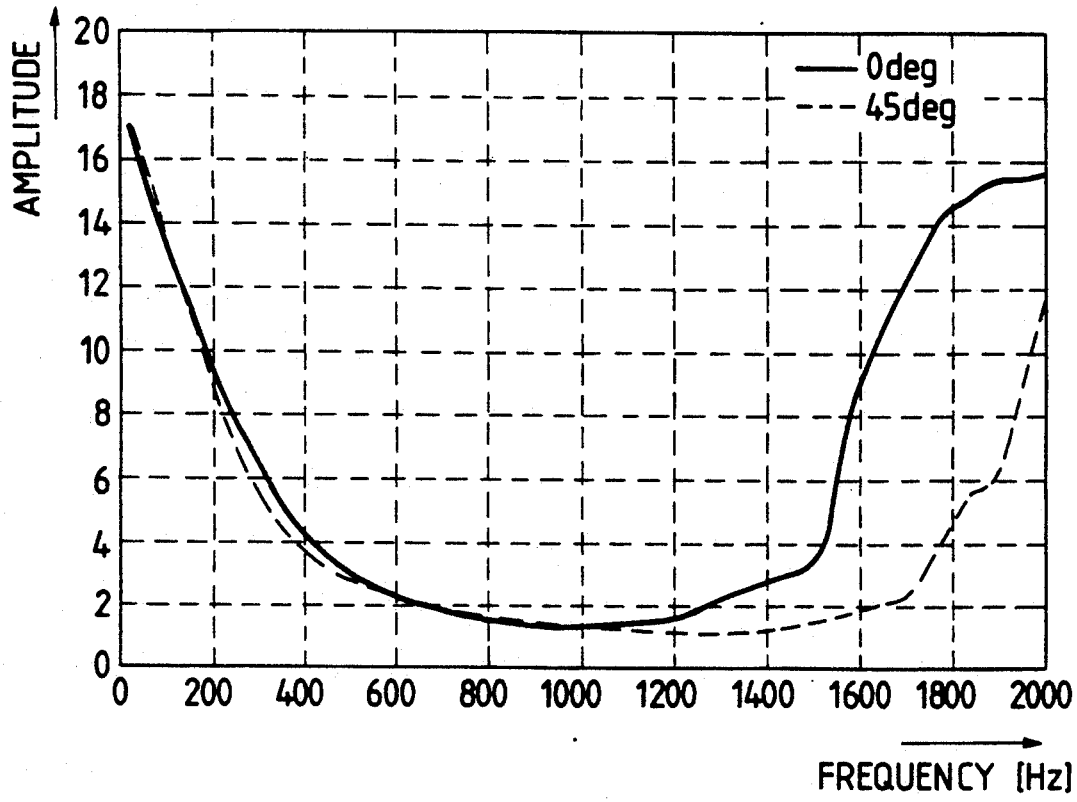
FIG. 36 is a graph diagram showing the frequency characteristic of an error evaluation function of the latticelike speaker array.

On the other hand, in the case of the lattice-like speaker array, a total of 81 speaker units are employed. Its characteristic is, as shown in FIG. 36, the upper limit frequency at which the directivity can be controlled is 1800 Hz on the 0° axis, while that drops down to 1500 Hz on the 45° axis.

Thus, the lattice-like speaker array exhibits variations in the upper limit frequency at which the directivity can be controlled, and also involves some additional wasteful speaker units, the honeycomb-like speaker array exhibits high upper limit frequencies and can be implemented with a fewer number of speaker units.

In the third embodiment, the process of setting required filter coefficients $\alpha hi$ to the respective digital filters $DF_1$ to $DF_m$ by using direct FIR filters as the digital filters $DF_1$ to $DF_m$ and calculating the filter coefficients for controlling directivity is the same as that in the first and second embodiments. Thus, the drawings and description of the first and second embodiments will similarly apply to the third embodiment. In addition, the microphones are arranged so as to constitute a spherical surface of which the center is at a position separated from the central position of the speaker array by a predetermined distance.

As has been described, according to the first embodiment of the invention, the filter coefficients for implementing a desired directivity pattern are set to the digital filters connected to linearly arranged speaker units. Therefore, a fine directivity control can be performed electrically with the same speaker structure and arbitrary directivity patterns can be obtained by changing the filter coefficients.

According to the second embodiment of the invention, a directivity pattern not only in the horizontal direction but also in the vertical direction can be controlled electrically while using a planar speaker array in a matrix form without changing the structural arrangement of a speaker system.

According to the third embodiment of the invention, the directivity pattern not only in the horizontal direction, but also in the vertical direction, can be controlled electrically while using a honeycomb-like planar speaker array. In addition, compared to the speaker array in matrix (lattice) form, the upper limit frequency at which the directivity is controllable can be increased, while the number of units involved can be reduced.

We claim:

1. A speaker system comprising:

a common input terminal for receiving an audio signal to be acoustically radiated;

a plurality of linearly arranged speaker units;

a plurality of digital filters connected between said common input terminal and said speaker units, respectively, said plurality of digital filters having filter coefficients corresponding to said speaker units, respectively; and a controller means, coupled to said digital filters, for determining said filter coefficients by a nonlinear optimization method in accordance with a target directivity pattern for acoustic radiation from said plurality of speaker units.

2. The speaker system as defined in claim 1, further comprising a plurality of acoustic receivers for receiving acoustic outputs of said speaker units, respectively, said acoustic receivers being coupled to said controller, and said controller determining said filter coefficients in accordance with the target directivity pattern and in accordance with outputs of said acoustic receivers.

3. The speaker system as defined in claim 1, further comprising a plurality of amplifiers connected between said plurality of digital filters and said speaker units, respectively, for amplifying outputs of said digital filters.

4. The speaker system as defined in claim 1, further comprising a memory for storing the determined filter coefficients, and an input device for inputting instruction signals to said controller.

5. The speaker system as defined in claim 1, wherein said controller is a CPU.

6. The speaker system as defined in claim 1, wherein each of said speaker units is of a same construction.

7. A speaker system comprising:

a common input terminal for receiving an audio signal to be acoustically radiated;

a plurality of speaker units, said speaker units being arranged on a plane in a matrix form;

a plurality of digital filters connected between said common input terminal and said speaker units, each of said plurality of digital filters having a filter coefficient which corresponds to said speaker units; and a controller, coupled to said digital filters, for determining said filter coefficients according to a nonlinear optimization method in accordance with a target directivity pattern for acoustic radiation from said plurality of speaker units.

8. The speaker system as defined in claim 7, further comprising a plurality of acoustic receivers for receiving acoustic outputs of said speaker units, said acoustic receivers being coupled to said controller, and said controller determining said filter coefficients in accordance with the target directivity pattern and in accordance with outputs of said acoustic receivers.

9. The speaker system as defined in claim 7, further comprising a plurality of amplifiers, an output of each of said amplifier being connected to an input of a different one of said speaker units.

10. The speaker system as defined in claim 7, wherein each of said speaker units is of a same construction 11. A speaker system comprising:

a common input terminal for receiving an audio signal to be acoustically radiated;

a plurality of speaker units, said speaker units arranged on a plane in a honeycomb form;

a plurality of digital filters connected between said common input terminal and said speaker units, each of said plurality of digital filters having a filter coefficient which corresponds to said speaker units; and a controller, coupled to said digital filters, for determining said filter coefficients by a nonlinear optimization method in accordance with a target directivity pattern for acoustic radiation from said plurality of speaker units.

12. The speaker system as defined in claim 11, further comprising a plurality of acoustic receivers for receiving acoustic outputs of said speaker units, said acoustic receivers being coupled to said controller, and said controller determining the filter coefficient in accordance with the target directivity pattern and in accordance with output of said acoustic receivers.

13. The speaker system as defined in claim 11, wherein each of said speaker units has a same construction.

14. A method of controlling a directivity of a speaker system having digital filters connected between a common input signal terminal and a plurality of speaker units, each of said digital filters providing an output in accordance with a filter coefficient, said method comprising the steps of:

arranging said speaker units;

determining a filter coefficient for each of said digital filters by a nonlinear optimization method in accordance with a target directivity pattern for acoustic radiation from said plurality of speaker units; and setting each Of said digital filters with the determined filter coefficients, respectively.

15. The method as defined in claim 14, wherein said arranging step includes linearly arranging said speaker units.

16. The method as defined in claim 14, wherein said arranging step includes arranging said speaker units in a matrix form.

17. The method as defined in claim 14, wherein said arranging step includes arranging said speaker units in a honeycomb form.

18. The method as defined in claim 14, further including the step of providing a plurality of acoustic receivers for obtaining acoustic outputs of said plurality of speaker units, respectively, and wherein said determining step determines the filter coefficient for each of the digital filters in accordance with the target directivity pattern and in accordance with the obtained acoustic outputs of said plurality of speaker units.

19. The method as defined in claim 15, further including the step of providing a plurality of acoustic receivers for obtaining acoustic outputs of said plurality of speaker units, respectively, and wherein said determining step determines the filter coefficient for each of the digital filters in accordance with the target directivity pattern and in accordance with the obtained acoustic outputs of said plurality of speaker units, and wherein each of said plurality of acoustic receivers is arranged along a predetermined radius from said plurality of speakers.

* * * * *